US005263698A

United States Patent [19]

Higuchi et al.

[11] Patent Number: 5,263,698

[45] Date of Patent: Nov. 23, 1993

[54] BINDING DEVICE FOR AN IMAGE FORMING APPARATUS WITH COVER SHEET

[75] Inventors: Masami Higuchi, Yokohama; Tsuneo Kurotori, Tokyo; Hiroshi Yasuda; Fumio Kishi, both of Yokohama; Takashi Seto, Ayase; Masakuni Kutsuwada, Tokyo, all of Japan

[73] Assignee: Ricoh Company, Ltd., Tokyo, Japan

[21] Appl. No.: 897,454

[22] Filed: Jun. 10, 1992

[30] Foreign Application Priority Data

Jun. 10, 1991 [JP] Japan ..... 3-13792
Jun. 17, 1991 [JP] Japan ..... 3-143728

[51] Int. Cl.[5] ..... B42B 2/00; G03G 21/00
[52] U.S. Cl. ..... 270/53; 355/324
[58] Field of Search ..... 270/53; 355/324

[56] References Cited

U.S. PATENT DOCUMENTS 4,194,832 3/1980 Tobayashi ..... 355/324 X
4,626,156 12/1986 Baughman et al. ..... 355/324 X
4,695,155 9/1987 Ishii et al. ..... 355/271 X
4,763,167 8/1988 Watanabe et al. ..... 355/324 X
4,905,054 2/1990 Rood ..... 355/324
5,131,641 7/1992 Hidaka ..... 270/53

FOREIGN PATENT DOCUMENTS 0074075 4/1988 Japan ..... 355/324

*Primary Examiner*—Edward K. Look
*Assistant Examiner*—John Ryznic
*Attorney, Agent, or Firm*—Oblon, Spivak, McClelland, Maier & Neustadt

[57] ABSTRACT

A binding device associated with an image forming apparatus for binding a stack of recording sheets each carrying an image formed by the image forming apparatus. After a cover sheet at least twice as large in size as the recording sheets has been laid on the stack, a staple or staples are driven into the cover sheet and underlying recording sheets to staple them together. Subsequently, the cover sheet is folded at substantially the center thereof in such a manner as to wrap the stapled stack. Binding means is located at the right-hand side or the left-hand side and capable of binding the stack at the right binding margin or the left binding margin, as desired by rotating the image formed on a sheet 180 degrees.

4 Claims, 37 Drawing Sheets

BINDING DEVICE FOR AN IMAGE FORMING APPARATUS WITH COVER SHEET

BACKGROUND OF THE INVENTION

The present invention relates to an image forming apparatus for forming an image on a sheet and, more particularly, to a binding device for binding a stack of sheets each carrying an image formed by the image forming apparatus.

A modern image forming apparatus, e.g., a copier, laser printer or facsimile transceiver is operable with a finisher capable of sorting or stacking sheets each carrying an image thereon and binding a stack of such sheets. A current trend is toward a miniature finisher with versatile functions from the value added standpoint. Regarding the binding function, various kinds of systems have been proposed in, among others, the printing art and may generally be classified as follows.

(I) Pasting

Pasting is a traditional scheme and usually pastes the cut edges of the back of printings. To prevent the pasted printings from being loosened, a piece of cloth may be additionally pasted to the back of the printings. A binding device using this kind of scheme is disclosed in, for example, Japanese Patent Laid-Open Publication No. 253992/1990.

(II) Fastening at Center

This binding system is orthodox and quite popular with, for example, magazines. The system is such that sheets stacked in order of page are provided with a stapling portion at the center thereof and then folded in two at the stapling portion.

(III) Stapling after Folding

This binding system folds a stack of printings in, for example, two and then staples the folded stack. For example, Japanese Patent Laid-Open Publication No. 196677/1987 proposes a binding device having a single sheet staple tray and binding means in the form of a stapler provided on the tray. The binding device folds, for example, sheets of A3 size such that opposite side edges thereof do not overlap each other, staples the resulting sheet stack of A4 size in the stable tray, and releases an end fence supporting one edge of the sheets to cause the sheet stack to fall from the staple tray into another tray disposed below the staple tray by gravity.

(IV) Stapling Sheet Stack with Front and/or Rear Cover

After a front and/or a rear cover has been laid on the top or the bottom of a sheet stack, the former is stapled together with the latter. This binding scheme is becoming popular in the finishers art.

(V) Simply Stapling Sheet Stack

A sheet stack is directly bound by a stapler. This is the most simple system and may implement a binding device for a copier in the manner taught in Japanese Patent Laid-Open Publication No. 33065/1990 by way of example. The binding device has a single sheet staple tray and a stapler provided on the tray. After a sheet stack has been stapled in the staple tray, an end fence supporting one edge of the sheets is shifted in the intended direction of sheet transport, i.e., sideways to discharge the stapled stack from the tray.

The problem with all the conventional binding systems (I)–(V) described above is that they cannot achieve high binding quality, increase the area for the installation of the binding device as well as the cost, and require troublesome handling.

Specifically, the system (I) involves a number of steps including cutting, pasting, and pasting a piece of cloth and, therefore, cannot be mechanized or automated without resorting to a large scale, complicated and, therefore, expensive device. The system (II) is simple, but it has to staple a sheet stack fully arranged in order of page and, therefore, requires a complicated procedure for page arrangement. Moreover, the stapled stack is apt to become loose at the center thereof. The system (III) needs a complicated step in folding printings in two and exposes the bent portions of staples to the outside. Such bent portions not only degrade the appearance of stapled stacks but also often catch the operator's fingers. Another problem with the system (III) is that the device is bulky since major part of the stapler body is located above and outside of the sheet area in order to staple a folded stack. The binding device disclosed in Japanese Patent Laid-Open Publication 196677/1987 causes a stapled stack to fall from the staple tray to the underlying tray by gravity. This is undesirable since the individual sheets of the stack are apt to fold during the fall and to become loose due to the air pressure and physical friction acting on the stack, the impact at the end of the fall, etc. The systems (IV) and (V) also have a problem that the bent portions of staples are bare and, therefore, apt to catch the operator's fingers while degrading the appearance. This is especially true when the sheet stack is relatively thin, since the bent portions of staplers would noticeably protrude from the stack.

On the other hand, in the binding devices taught in Japanese Patent Laid-Open Publication Nos. 196677/1987 and 33065/1990, a hammering section and a seat included in the stapler are rotatably supported in the vicinity of and outside of the sheet stacking region. Hence, such a device can bind a sheet stack only at the ordinary left binding margin of the latter (corresponding to image information written in horizontal lines). It follows that the stapling position will be reversed in the right-and-left direction when it comes to sheets on which image information written in vertical lines are reproduced by an image forming apparatus. Locating a stapler at both sides of a sheet stack to allow a sheet stack to be bound at the right margin thereof would increase the overall size and cost of the binding device.

SUMMARY OF THE INVENTION

It is therefore an object of the present invention to provide a binding device for an image forming apparatus which prevents the stapled edges of sheets from folding at the time of fall and insures an attractive bound stack by concealing, for example, the bent legs of staples.

It is another object of the present invention to provide a binding device for an image forming apparatus which is selectively operable in an ordinary bind mode for binding sheets without a cover or in a special bind mode for binding sheets together with a cover which is at least twice as large in size as the sheets.

It is another object of the present invention to provide a binding device for an image forming apparatus which automatically binds a sheet stack while surely preventing individual sheets from being disclosed, even when stapling them at a minimum number of positions.

It is another object of the present invention to provide a miniature and inexpensive binding device for an image forming apparatus which has binding means capable of binding a sheet stack at either of a right and a left binding margin despite that it is located at one side in the binding device.

In accordance with the present invention, in a device for binding a stack of recording sheets each carrying an image formed by an image forming apparatus, the stack of recording sheets are stapled in any one of a plurality of predetermined modes.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of the binding device in accordance with the present invention will be described hereinafter. Although the embodiments will concentrate on an image forming apparatus implemented as a copier, they are, of course, practicable with any other kind of image forming apparatus, e.g., a laser printer or a facsimile transceiver.

First Embodiment

Figure 1:
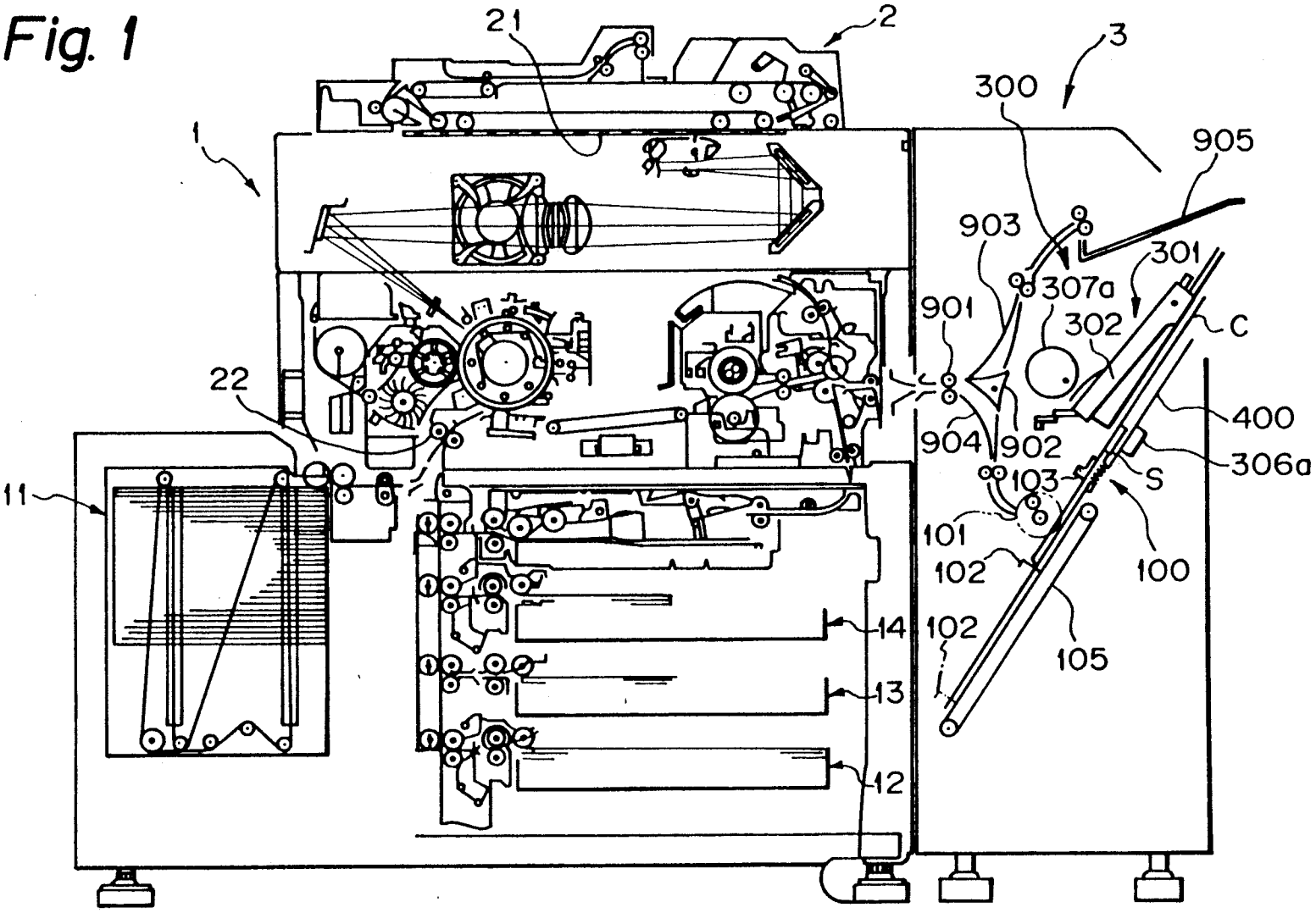
FIG. 1 is a section showing the general construction of a copier implemented with a first embodiment of the binding device in accordance with the present invention.
Figure 2:
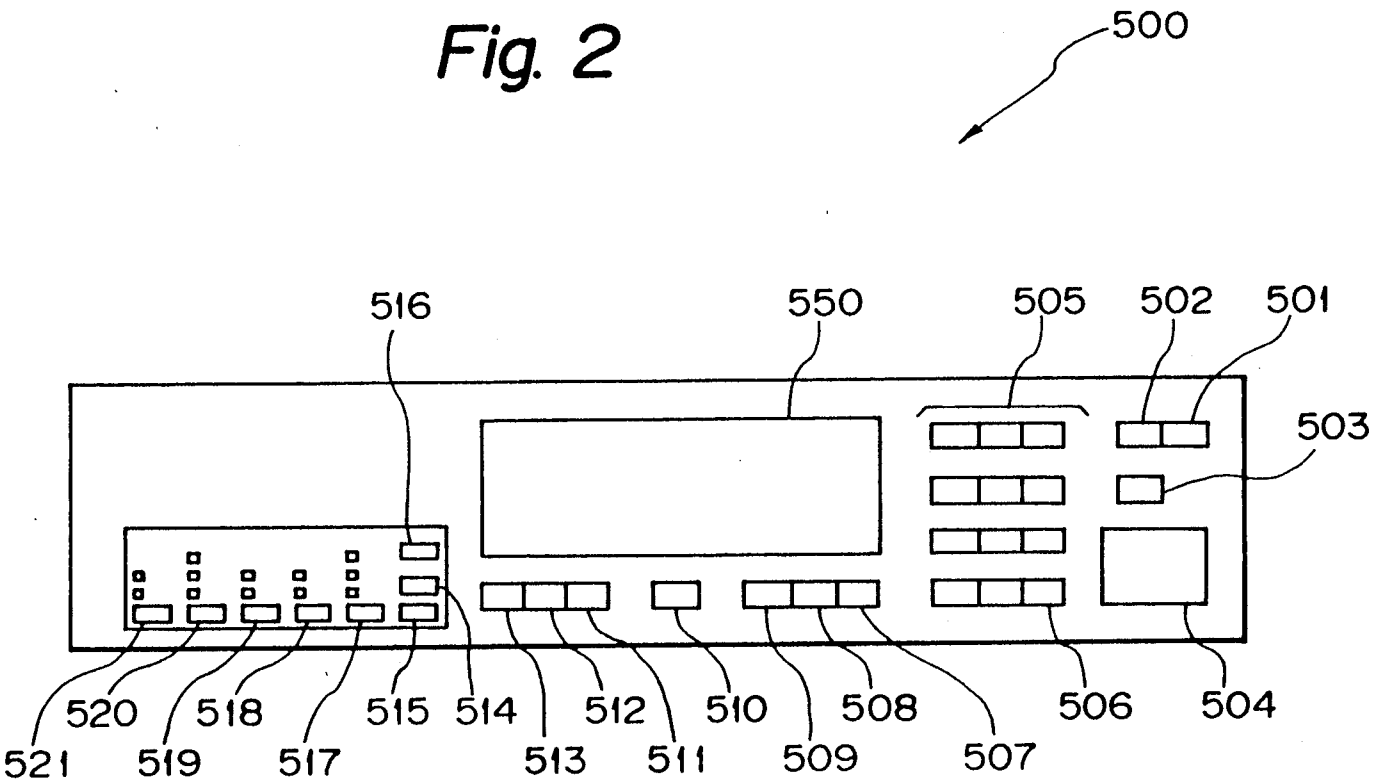
FIG. 2 is a plan view of an operation and display panel included in the embodiment.

A first embodiment will be described with reference to FIGS. 1–33. FIG. 1 shows a copier body 1, a recirculating automatic document feeder (RADF) 2 mounted on the top of the copier body 1, and a finisher 3 operatively connected to the right-hand side of the copier body 1. It is to be noted that FIG. 1 is a sectional front view as seen from the operating side where the operator is expected stand. An operation and display panel 500, FIG. 2, is provided on the top of the copier body 1 on the operating side. The operation and display panel 500 is operable to enter various kinds of commands relating to the copying operation, binding operation, etc. Also, the panel 500 displays information associated with such operations. The finisher 3 has a control 800, a jogging section 100, a stapling section 300, and a discharging section 200 which are shown in FIGS. 14–20 in detail. As commands relating to the binding operation are entered on the operation and display panel 500, the control 800 control the jogging section 100, stapling section 300 and discharging section 200 as well as other sections included in the copier. Sheet cassettes 11–14 are also mounted on the copier body 1. Since the copier body 1 itself belongs to a family of conventional apparatuses for forming an image by an electrophotographic process, the construction and operation thereof will not be described specifically. A recording sheet, or copy, driven out of the copier body 1 is admitted into the finisher 3 and transported by a roller 901. A path selector in the form of a pawl 902 is located downstream of the roller 901 and movable to select any one of a first and a second transport path 903 and 904. The sheet steered into the first transport path 903 by the path selector 902 is driven out onto a proof tray 905. On the other hand, the sheet introduced into the second transport path 904 is transported to a finish tray 400.

Various sections constituting the finisher 3 will be described specifically together with the operation and display panel 500 of the copier body 1 and the RADF 2.

Operation and Display Panel 500

Figure 3:
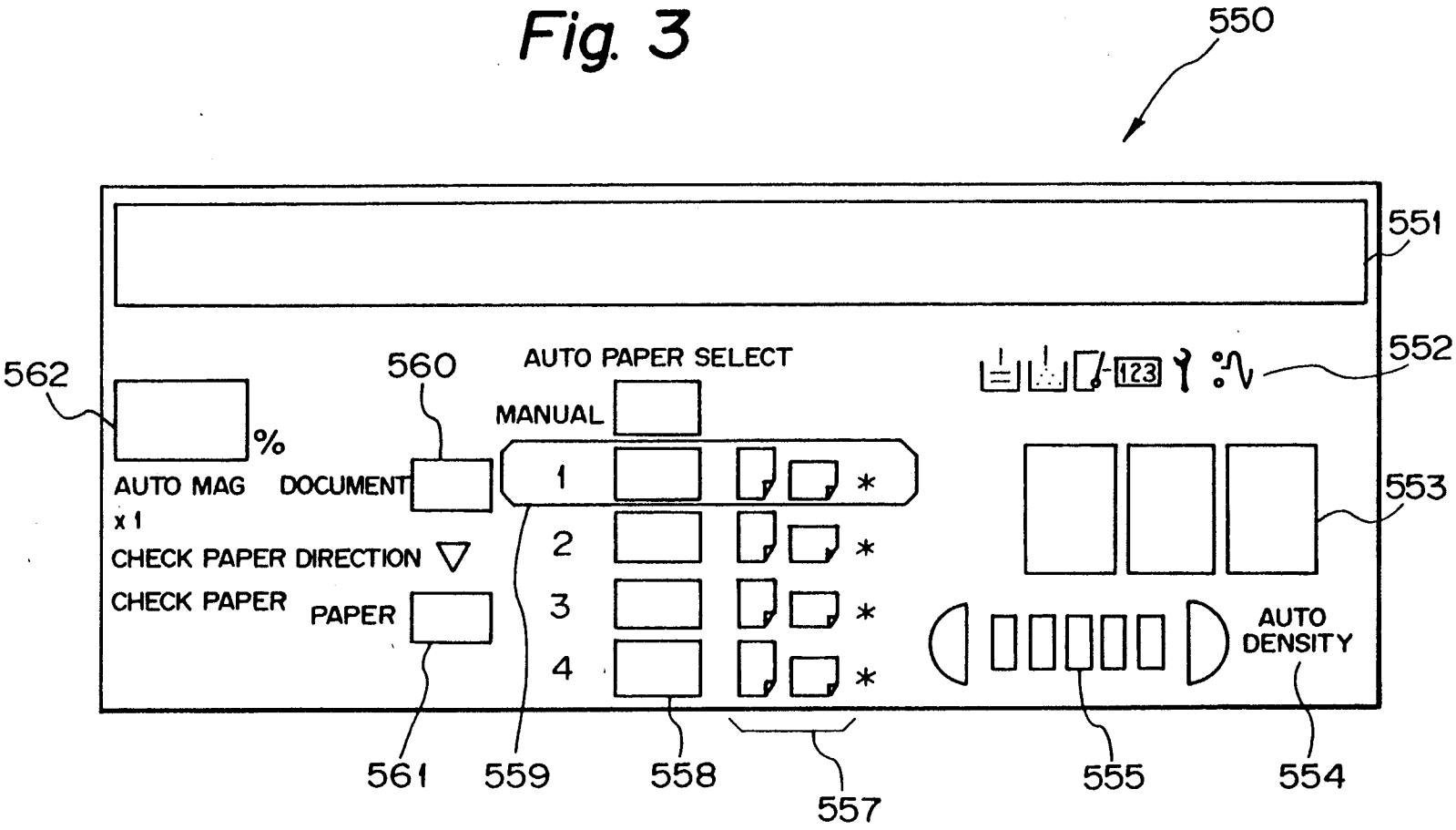
FIG. 3 is a fragmentary enlarged view of a liquid crystal display section shown in FIG. 2.

As shown in FIGS. 2 and 3, the panel 500 includes a mode clear/preheat key 501. When pressed for a moment, the key 501 functions as a mode clear key for substituting standard modes for entered modes. When pressed continuously, the key 501 turns into a preheat key for selectively setting up or cancelling the heat state of the machine. An enter key 502 is used to enter numerical values representative of a zoom magnification and a binding margin. An interrupt key 503 is operable to effect interrupt copying. A print key 504 is pressed to start a copying operation. The print key 504 also plays the role of a ready/wait indicator, i.e., it has a green light emitting diode (LED) and a red LED which glow in a ready state and a wait state, respectively. Numeral keys 505 are operable to enter a desired number of copies, a desired zoom magnification, and a desired binding margin in numerical values. A clear/stop key 506 functions as a clear key in a standby state or as a stop key while a copying operation is under way; the clear key cancels the entered number of copies while the stop key interrupts the copying operation, i.e., causes the machine to stop as soon as the copying cycle under way is completed.

As shown in FIG. 3 in detail, a liquid crystal display (LCD) section 550 has a message display 551 for displaying information associated with the machine, e.g., messages "READY" and "SUPPLY PAPER". An auto density key 507 may be pressed to cause the copy density to be automatically adjusted in matching relation to the background density of documents. When this key 507 is pressed, an auto density indicator 554 glows. Density adjust keys 508 and 509 may be operated to adjust the copy density by hand; every time the key 508 or 509 is pressed, density indicators in the form of LEDs 555 sequentially glow from the right to the left and vice versa. A sheet select key 510 causes a sheet selection display frame 559 to sequentially move every time it is pressed, showing the operator automatic sheet selection, manual sheet insertion, or one of the sheet cassettes 11–14 selected. The "automatic sheet selection" will be selected for allowing a sheet cassette loaded with sheets of the same size as the documents to be automatically selected. The "manual sheet insertion" will be selected when the operator desires to feed sheets by hand without using the cassettes. Indicators 558 each indicates the sheet sizes of the cassettes and the absence of sheets.

Also arranged on the operation and display panel 500 are a ×1 key 511, an enlarge key 512, and a reduce key 513 for selecting, respectively, ×1 copying, and the enlargement and the reduction of regular sizes. A zoom up key 514 and a zoom down key 515 which may each be operated to set up any desired magnification within the range of 64–142%. A sheet-priority magnification change key 516 is operable to reduce or enlarge a document image automatically in matching relation to the size of sheets selected; the magnification appears in a magnification display section 562 in numerals. A two-sided copy key 517 may be pressed to reproduce one-sided or two-sided documents on both sides of sheets or reproduce two-sided documents on one side of sheets. When this key 517 is pressed, one of LEDs positioned above the key 517 glows. A binding margin key 518 is accessible for setting up a desired binding margin smaller than 21 millimeters on either side. In the case of two-sided copies, a binding margin may be set up even on the rear of the copies independently of the margin on the front. The binding margin selected appears in the message area. A stapler select key 519 may be pressed to select a single staple mode, a two staple mode, or a no staple mode. A cover select key 520 may be pressed to select a front cover mode, a rear cover mode, a front and rear cover mode, or a no cover mode, i.e., to add a single sheet or cover sheet of the same size as a stack of recording sheets to the front, to the rear or to both the front and the rear of the stack, or to add no such cover sheets. A binding procedure available with the stapler select key 519 and cover select key 520 are conventional and, therefore, will not be described specifically. The following description will concentrate on a simple sheet bind mode.

Figure 4:
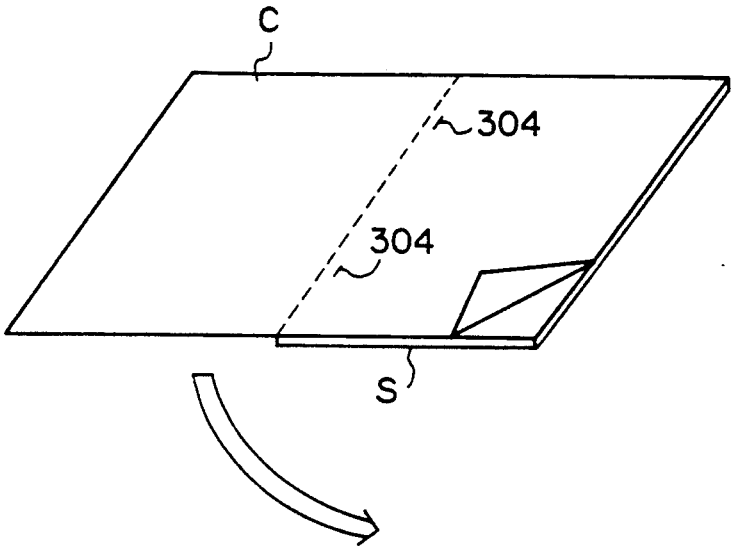
FIG. 4 is a perspective view of a sheet stack stapled by the embodiment.

Specifically, a simple bind key 521 is provided on the operation and display panel 500 and accessible for selecting a simple sheet bind mode (hereinafter abbreviated as an SSB mode) or an SSB cancel mode. Usually, when a stack of documents are set on a document table included in the RADF 2, sheets of particular size matching a magnification change ratio are selected. In the SSB mode, only the sheets stacked on a sheet cassette such that their lengthwise direction coincides with the front-and-rear direction of the copier, i.e., the stapling section 300 are selected. More specifically, in the SSB mode, the sheets whose widthwise direction coincides with the above-mentioned direction are not selected. It is to be noted that the term "front-and-rear directio" which will appear hereinafter refers to the above-mentioned direction. Preferably, a sheet to serve as a cover, i.e., a cover sheet should have a widthwise dimension equal to the lengthwise dimension of the recording sheets selected and have a lengthwise dimension at least twice as large as the widthwise dimension of the recording sheets selected. For example, when recording sheets of A4 size are selected, a sheet of regular A3 size will suffice as a cover; in practice, the cover should preferably be about 5 millimeters longer than A3 or similar regular size in the lengthwise direction. Desirably, therefore, exclusive sheets of such irregular sizes may be accommodated in a sheet cassette in addition to recording sheets of regular sizes. The SSB mode is practicable in two different modes, i.e., a cover SSB mode meant for a stack of documents with a cover or covers and a no cover SSB mode meant for a stack of documents without a cover. In the cover SSB mode, the last document of a document stack is determined to be a cover, the image of the cover document is reproduced on a sheet fed from an exclusive sheet cassette as a cover, and then the sheet is transported to the finisher 3. In the no cover SSB mode, after the last document has been reproduced, a sheet to serve as a cover is directly fed from the sheet cassette to the finisher 3. A bind key 521 is operable to select the cover SSB mode or the no cover SSB mode. FIG. 4 shows a specific stack of recording sheets, or copies, S with a cover C produced by the SSB mode.

As shown in FIG. 4, in the SSB mode of the embodiment, the cover C is at least twice as large as the sheets S and formed in such a manner as to wrap the binding margin where staples 304 are positioned. The cover C, therefore, protects the edges of the sheets S on the binding side from folding. Further, in the SSB mode, the staples 304 extend throughout the stack S from the cover C side and have their legs bent. At this instant, since the bent legs of the staples 304 are concealed by the cover C, the bound stack has attractive appearance and, in addition, the operator is prevented from touching the bent legs.

Figure 5:
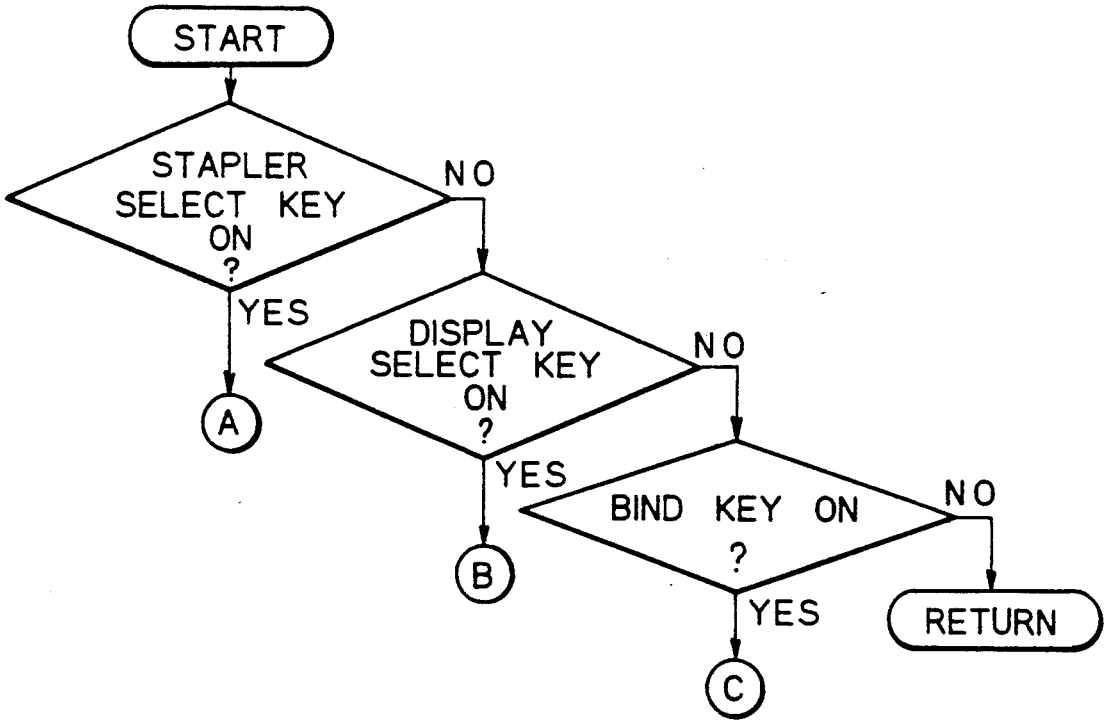
FIG. 5 is a flowchart representative of processing associated with various keys associated with binding.
Figure 6:
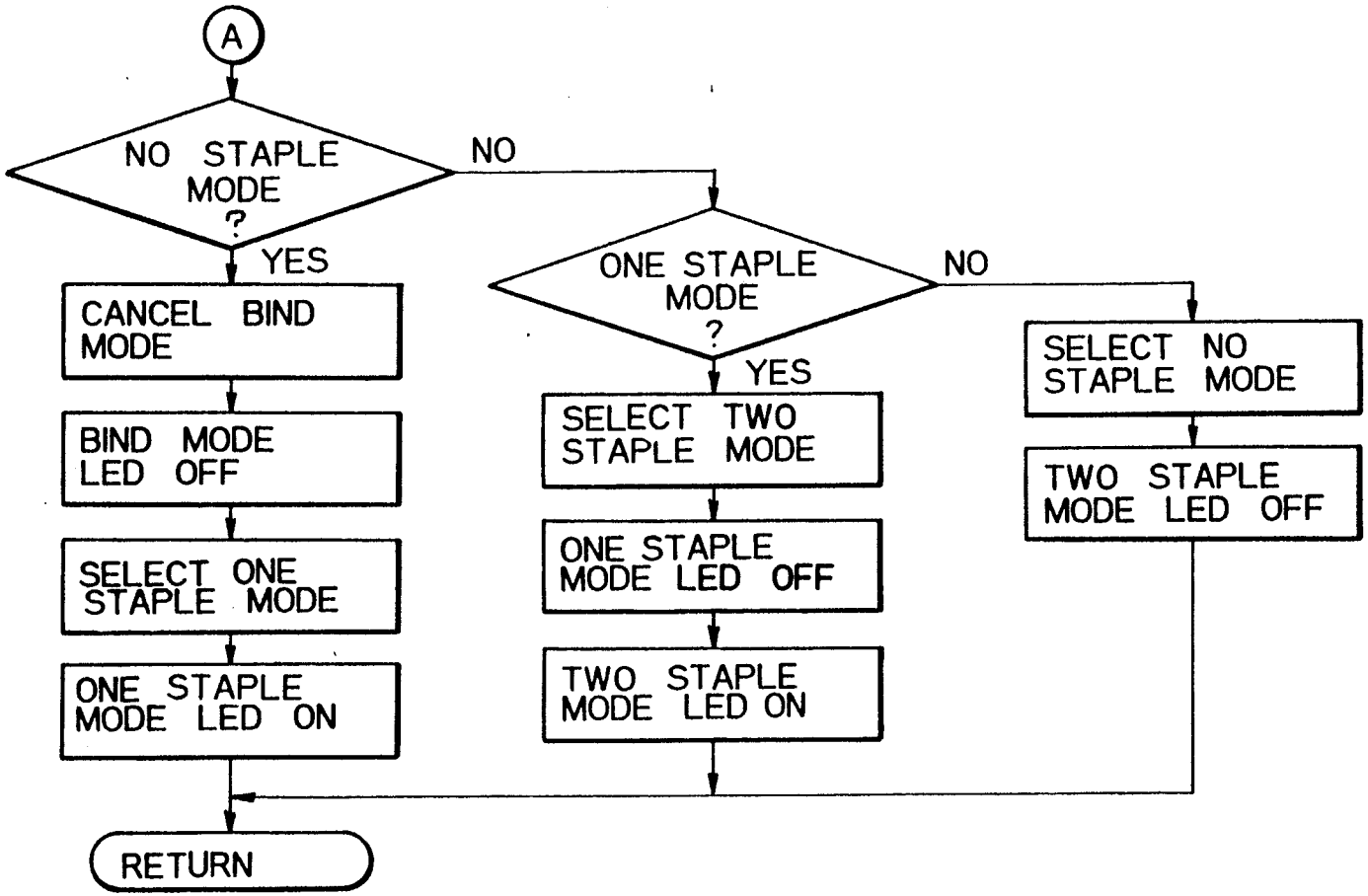
FIGS. 6, 7 and 8 are flowcharts associated with FIG. 5.
Figure 7:
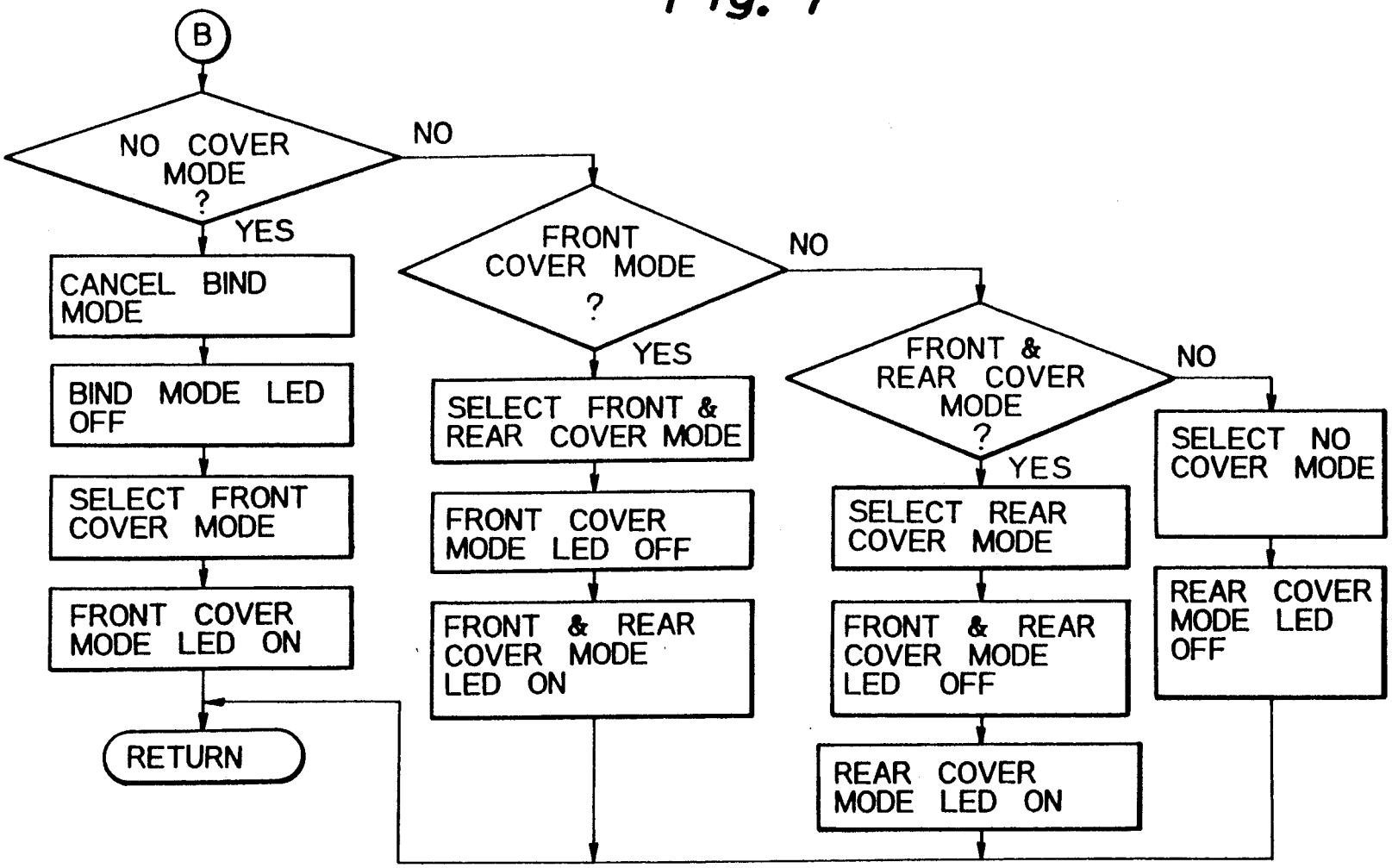
Figure 8:
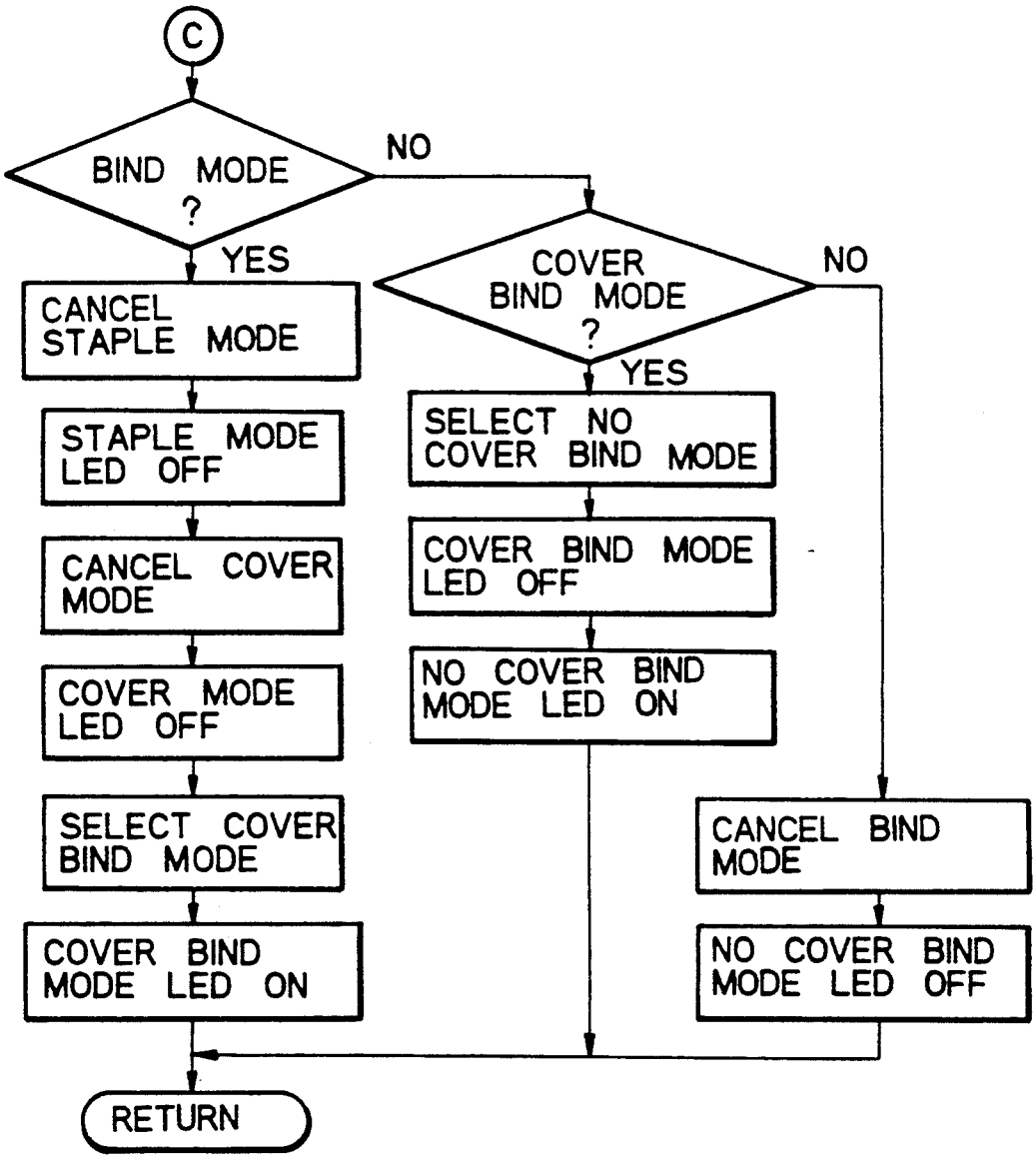

Usually, in the SSB mode, the cover SSB mode, the front cover mode and the two staple mode are automatically selected while the staple mode and cover mode are automatically cancelled. This not only reduces the operator's work but also guarantees sure binding. LEDs are associated with each of the staple select key 519, cover select key 520 and simple bind key 521 to indicate the modes selected. Operations associated with these keys 519, 520 and 521 will be described with reference to FIGS. 5–8. FIG. 5 shows a specific procedure wherein the keys 519, 520 and 521 are operated to select particular binding modes. FIGS. 6, 7 and 8 demonstrate more specific procedures associated with FIG. 5.

Assume that the staple select key 519 is turned on. Then, as shown in FIG. 6, if the no staple mode is set up, pressing the key 519 once cancels the bind mode and selects the single staple mode. If the no staple mode is not set up and the single staple mode is set up, pressing the key 519 once selects the two staple mode. Further, if the single staple mode is not set up, pressing the key 519 once selects the no staple mode.

Next, as the cover select key 520 is turned on, pressing the key 520 once cancels the bind mode and selects the front cover mode if the no cover is set up, as shown in FIG. 7. If the no cover mode is not set up and the front cover mode is set up, pressing the key 520 once selects the front and rear cover mode. If the front cover mode is not set up and the front and rear cover mode is set up, pressing the key 520 once selects the rear cover mode. Further, if the front and rear cover mode is not set up, pressing the key 520 selects the no cover mode.

Subsequently, as the simple bind key 521 is turned on, pressing it once cancels the staple mode and cover mode and selects a cover bind mode if the bind mode is selected, as shown in FIG. 8. If the bind mode is not set up and the cover bind mode is set up, pressing the key 521 selects the no cover bind mode. Further, if the cover bind mode is not set up, the bind mode is cancelled.

As stated above, the staple select key 519, cover select key 520 and simple bind key 521 are each capable of setting up different modes cyclically. Each mode is positively indicated by associated one of the LEDs.

RADF 2

Figure 9:
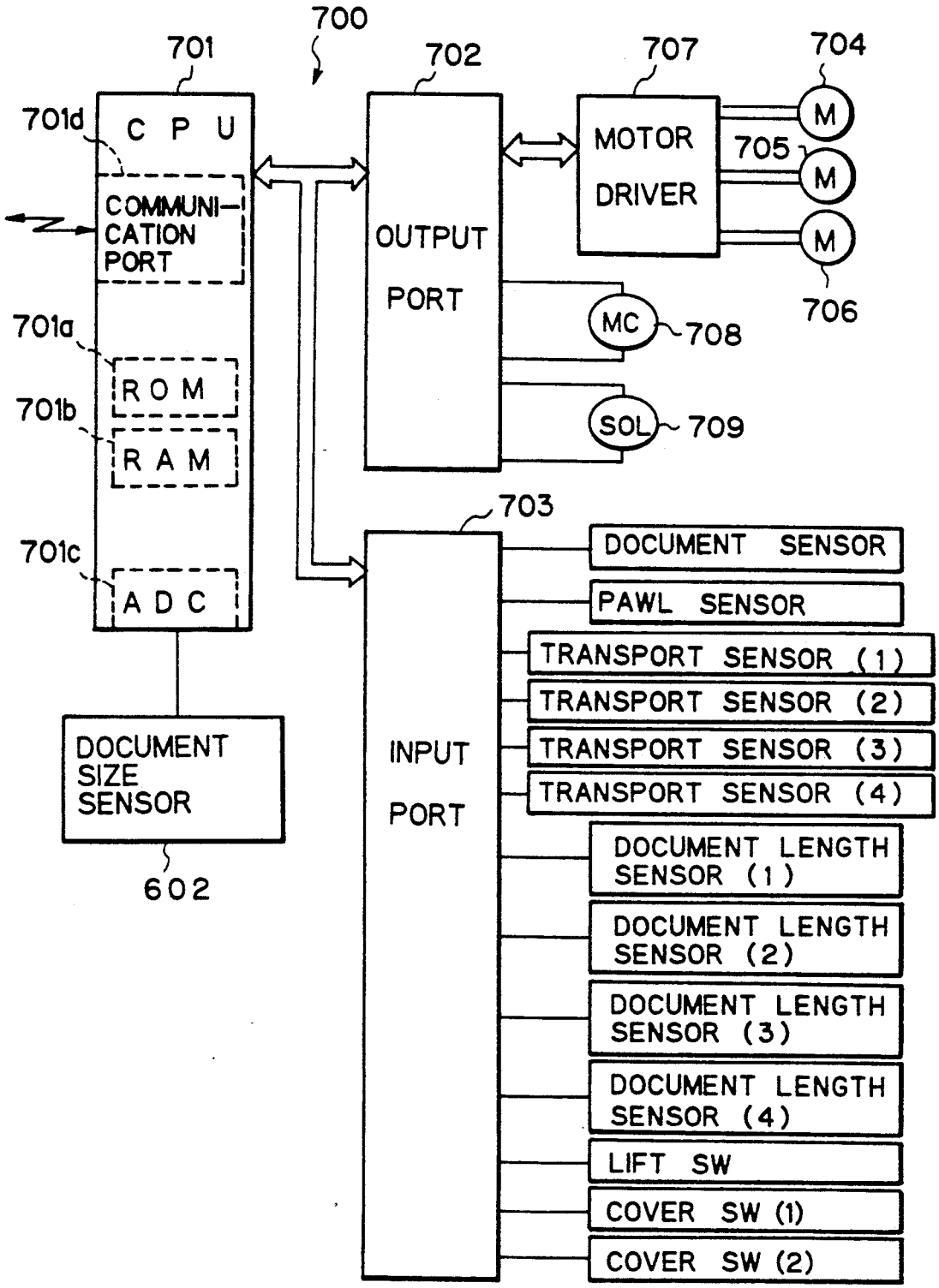
FIG. 9 is a block diagram schematically showing a control circuit incorporated in a recycling automatic document feeder (RADF) included in the embodiment.

Referring to FIG. 9, a control 700 incorporated in the RADF 2 includes a CPU (Central Processing Unit) 710 implemented as a one chip microcomputer having a ROM (Read Only Memory) 701*a*, a RAM (Random Access Memory) 701*b*, an analog-to-digital converter (ADC) 701*c*, and a serial communication port 701*d*. An output port 702 and an input port 703 are attached to the CPU 701. A motor driver 707 is connected to the output port 702 for driving a document transport motor 704, a belt drive motor 705, and a document discharge motor 706 at a constant speed. Further, the CPU 701 drives a feed clutch 708, a pawl solenoid 709, etc. Various signals including the output of a transport sensor and that of a document size sensor are applied to the input port 703. A procedure for the RADF 2 to feed a document will be described hereinafter together with a specific construction of part of the RADF 2.

(1) Document Setting

Figure 10:
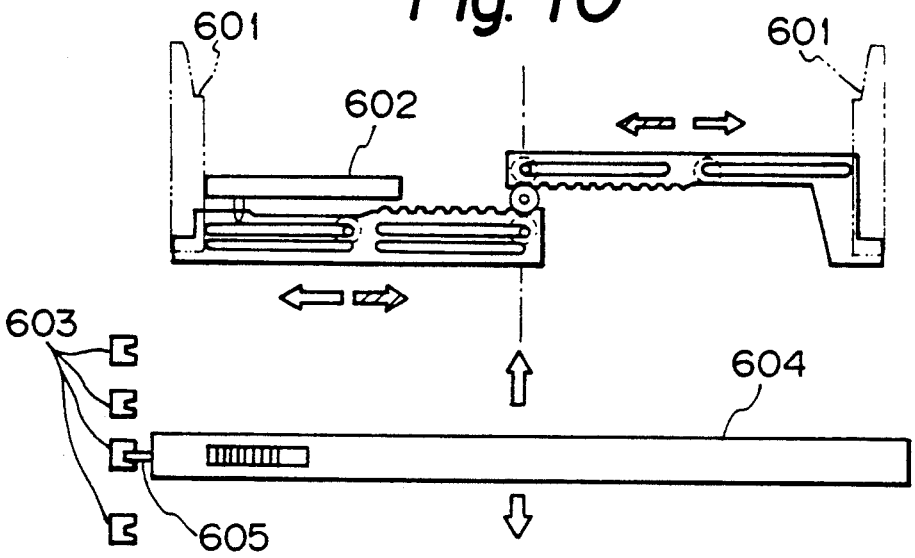
FIG. 10 is a view demonstrating how the RADF senses the size of documents.

As shown in FIG. 10, documents stacked on the document table are restricted by side guides 601 each being movable in a direction perpendicular to the direction of document feed, and an end plate 604 located at the rear and movable in the direction of document feed. A reflection type sensor, not shown, senses documents existing on the document table.

(2) Document Size Sensing

A document size sensor 602 is affixed to one of the side guides 601 and produces a signal representative of the size of documents as measured in a direction perpendicular to the direction of document feed. The signal terminal of the sensor 602 is connected to a 5 V ground signal line. The ADC 701*c* incorporated in the CPU 701 reads the output voltage of the sensor 602 to determine the width of the documents. A plurality of document length sensors 603 are affixed to the document table, and each coacts with associated one of click pawls 605. The length of the documents in the feed direction is determined on the basis of which of the sensors 603 senses the associated click pawl 605. Various sizes of documents can be dealt with on the basis of the combination of width and length.

(3) Document End Sensing

Figure 11:
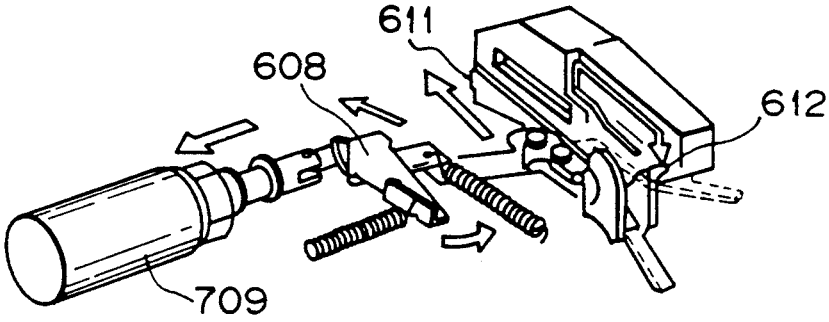
FIG. 11 is a fragmentary enlarged view of a mechanism included in the RADF for detecting the last document.
Figure 12:
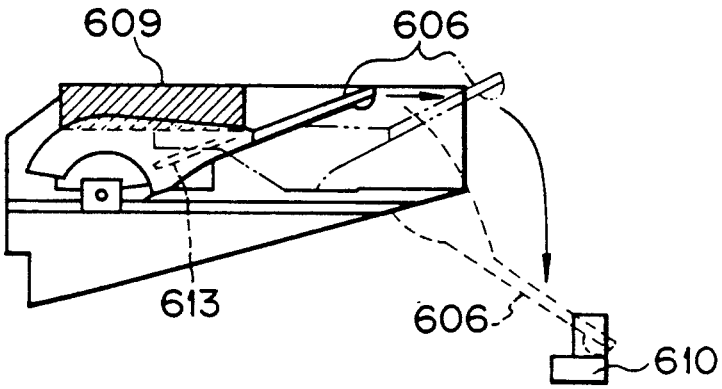
FIG. 12 is a view indicative of the operation of the mechanism shown in FIG. 11.

FIGS. 11 and 12 show a mechanism for sensing the end of documents. As shown, as a solenoid 709 is turned on and turned off before document feed, a division pawl 606 is moved between a solid line position, FIG. 12, (associated with the ON state of the solenoid 709) and a dash-and-dots line position (associated with the OFF state of the solenoid 709). When the solenoid 709 is in an OFF state, the division pawl 606 is rotatable from the dash-and-dots line position of FIG. 12 to a dotted line position of FIG. 12 and, at this instant, engages with a pawl sensor 610. After the pawl 606 has engaged with the pawl sensor 610, a stack of documents are put on the pawl 606. Then, the solenoid 709 is energized to cause an arm 606 to move along a rail 611 with the result that the division pawl 606 is pulled out from the underside of the documents. At the same time, a pin 612 is moved along a guide, not shown, to raise the free end of the pawl 606. A magnet 609 is disposed above the pawl 606 and attracts a raise plate 613 to thereby move the pawl 606 to its uppermost position. Subsequently, as the solenoid 709 is deenergized, the division pawl 606 rests on the top of the document stack under the action of a spring, not shown. When all the documents are fed out from below the division pawl 606, the pawl 606 is received in the pawl sensor 610 to show that the last document has been fed out.

(4) Document Transport Control

In the illustrative embodiment, the RADF 2 feeds last one of a stack of documents first, i.e., the cover of the document stack last. Hence, the RADF 2 performs the following operation.

(i) Timings for First Set of Sheets

Figure 13A:
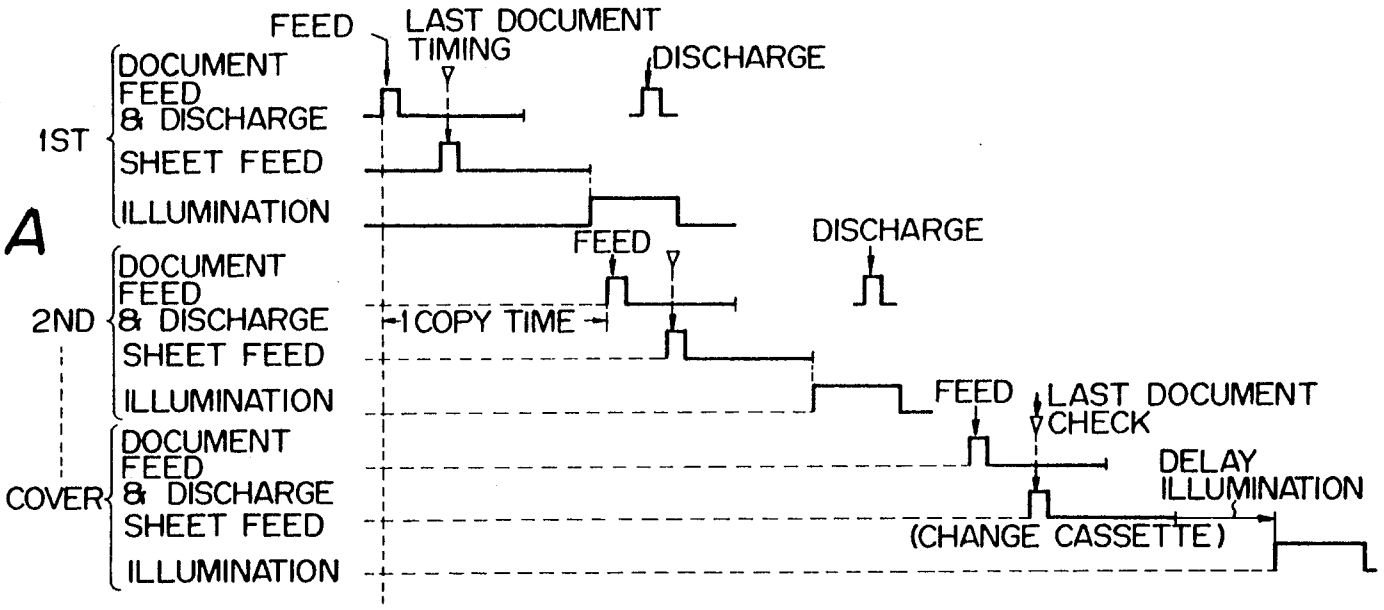
FIGS. 13A and 13B are timing charts representative of the document feed and discharge timings, sheet feed timing, and illumination timing with respect to the first set of sheets and the second set of sheets, respectively.

FIG. 13A is a timing chart associated with the first set of sheets and including document feed timings, illumination timing, and document discharge timing. As shown, after a document has been fed, the output of the pawl sensor 610 is checked to see if the document is the last document. If the document is not the last document, a sheet or recording sheet is fed from a given sheet cassette, and then the document begins to be illuminated at such a timing that the sheet coincides with an image. Before the illumination, the document is positioned on a glass platen 21, FIG. 1. After the illumination, the document is immediately discharged by a belt included in the RADF 2. The next document begins to be fed before the preceding document is discharged. Such a procedure is repeated with each of the documents. When the document to be fed is the last document, a sheet to serve as a cover, i.e., a cover sheet is fed from another sheet cassette in place of the above-mentioned cassette. At this instant, the illumination timing is controlled such that an image is formed at the downstream side of the cover sheet with respect to the direction of sheet transport. For this purpose, a register roller 22, FIG. 1, starts rotating at a time earlier than the time for ordinary images.

(ii) Timings for Second Set of Sheets

Figure 13B:
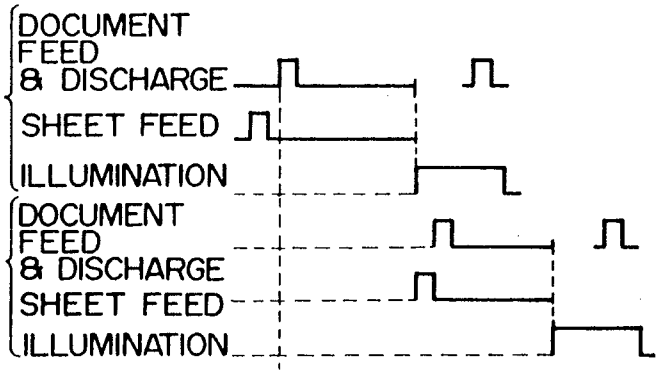

At the time when the first set of sheets are completed, the number of the documents up to the last document has been known. Therefore, as shown in FIG. 13B, the second and successive sets of sheets are produced at the timings determined by the document replacing operation, i.e., without determining whether or not the document is the last document.

(5) Sheet End Processing

When covers C are to be added in the SSB mode, two different sheet cassettes are used, one for recording sheets and the other for cover sheets. Sheet end processing is as follows:

(i) when recording sheets, as distinguished from cover sheets, end during copying using the recording sheets, the machine stops operating;

(ii) when cover sheets end during copying using recording sheets, the machine repeats copying with the recording sheets and stops operating at the time of copying which uses a cover sheet;

(iii) when recording sheets end at the time of copying using a cover sheet, the maching repeats copying with the cover sheet and stops operating at the time of copying which uses a recording sheet; and (iv) when cover sheets end at the time of copying using a cover sheet, the machine stops operating.

Figure 14:
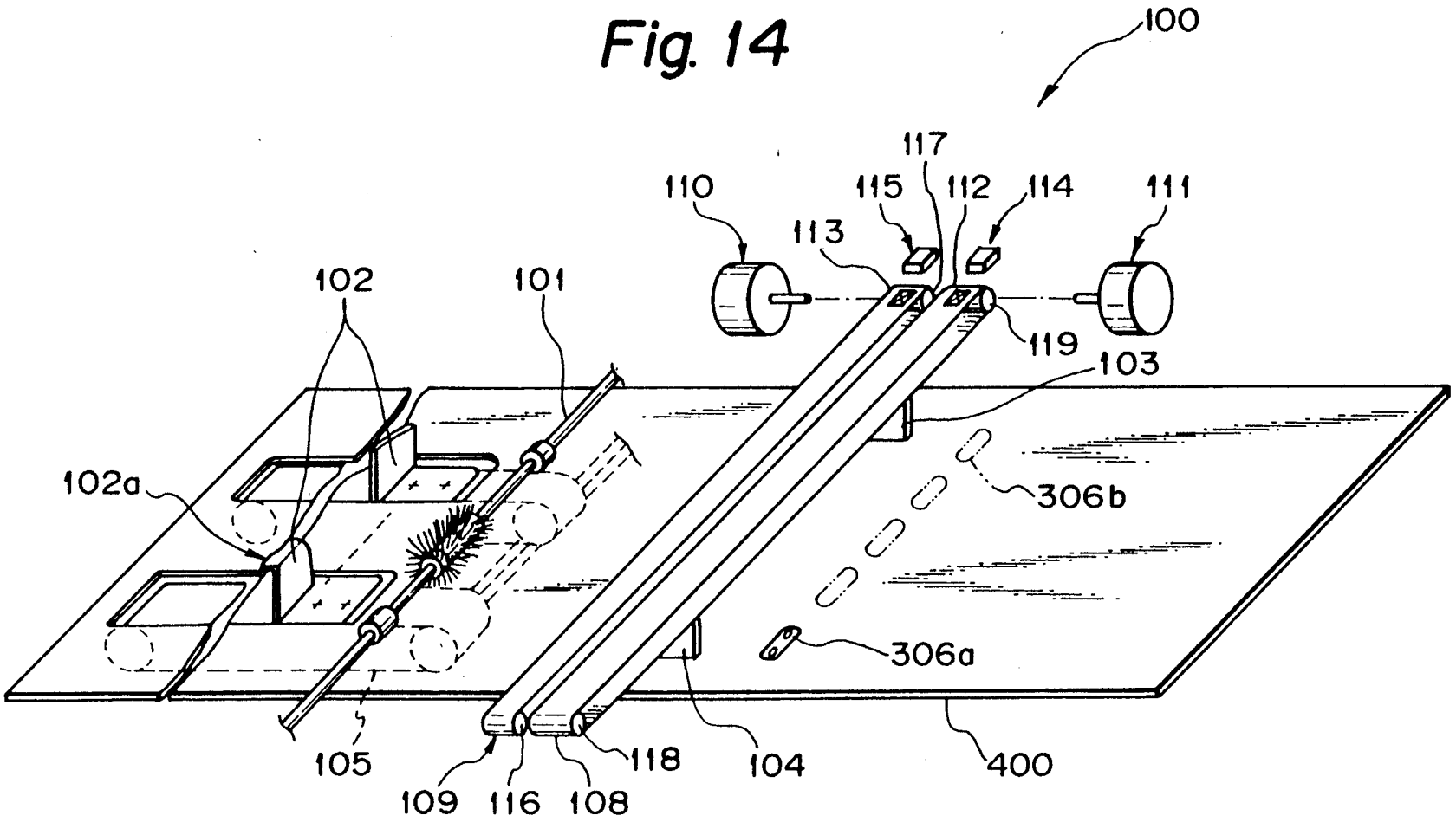
FIG. 14 is a fragmentary perspective view of a jogging section included in the embodiment.
Figure 15:
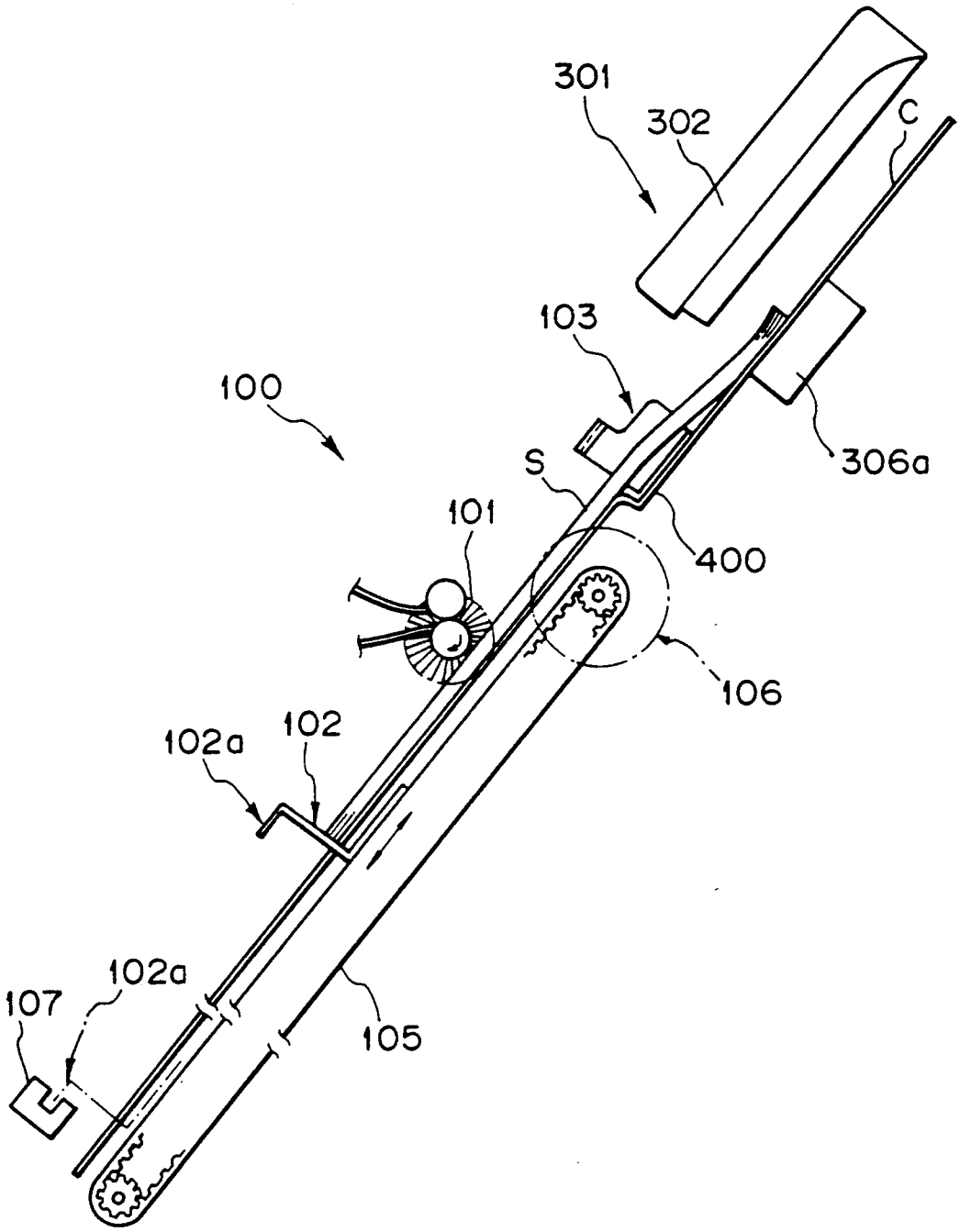
FIG. 15 is a fragmentary front view of the jogging section.
Figure 16:
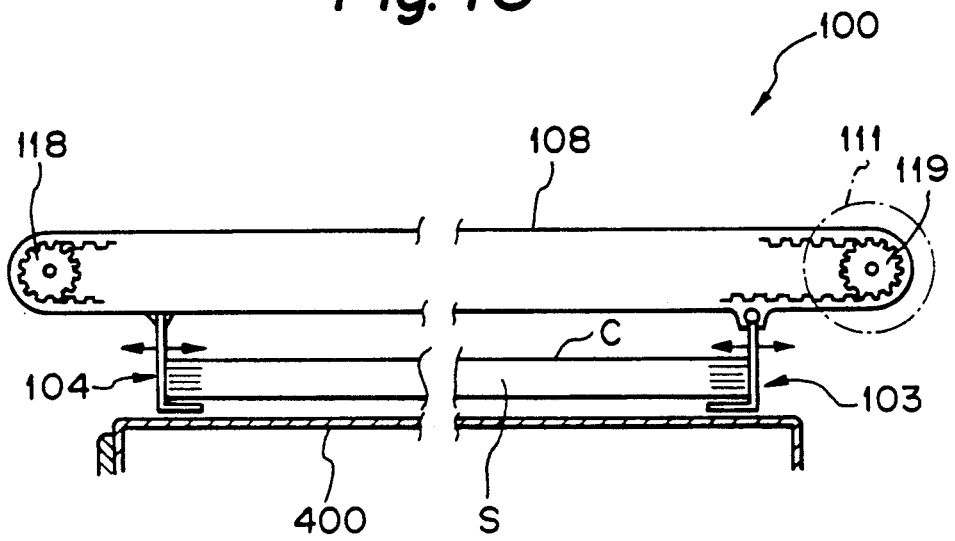
FIG. 16 is a view showing the operation of the jogging section.

As shown in FIGS. 14–17, as a recording sheet is driven out onto the finish tray 400 by the roller 901, FIG. 1, a brush roller 101 urges it against end fences 102 to position the leading edge thereof in the direction of sheet transport. Side fences 103 and 104 located at the rear and the front, respectively, jog to position the recording sheet in the front-and-rear direction. As shown in FIGS. 14 and 15, the end fences 102 are affixed to respective belts 105 which are driven by a motor 106. The end fences 102 are located at a particular position which allows a stack of sheets to be stapled at any desired positions matching the sheet size or the operator's taste (e.g. margins of documents and the binding margin to be produced by the copier). The end fences 102 have a reference position where lugs 102*a* thereof are sensed by an end fence home position sensor 107. The home position sensor 107 is located such that sheets of maximum size available with the copier can be stapled at an edge thereof. The side fences 103 and 104 are affixed to respective belts 108 and 109 above the sheets. The belts 108 and 109 are supported by respective pulleys 116–119 and driven by respective motors 111 and 110. Specifically, the side fences 103 and 104 are movable toward and away from each other in a reciprocating motion, as indicated by an arrow in FIG. 16. Patterns 112 and 113 are provided at predetermined positions on the belts 108 and 109, respectively. The side fences 103 and 104 each has a reference position where the pattern 112 or 113 thereof is sensed by associated one of sensors 114 and 115. It is to be noted that the movement for positioning a sheet in the front-and-rear direction, i.e., jogging movement occurs every time one sheet is discharged.

FIGS. 1 and 15 indicate the positional relation of the end fences 102, side fences 103 and 104, and a stapler body 302 of a stapler 301 which will be described. Specifically, the end fences 102 and the stapler body 302 are located to face each other while the side fences 103 and 104 are interposed between the end fences 102 and the stapler body 302.

Figure 17:
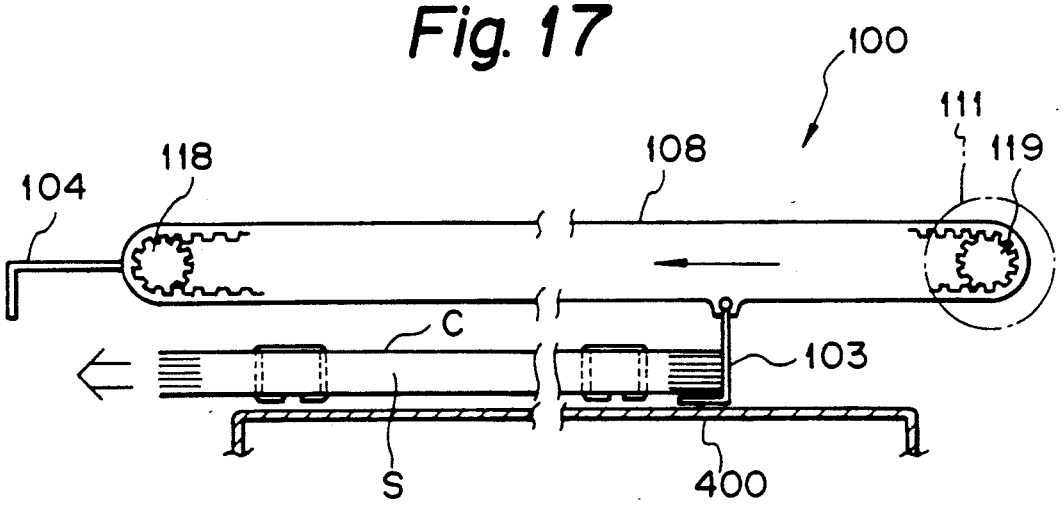
FIG. 17 is a view showing the operation of the jogging section for discharging a stapled sheet stack.

After a stapling operation which is effected by the stapler 301 and following the jogging operation, the side fences 103 and 104 are moved in the same direction as each other, as shown in FIG. 17. As a result, the stapled stack S is discharged to the front side of the finisher. At this instant, the front side fence 104 does not obstruct the discharge of the stack S since it moves along the circumference of the pulley 116. While the rear side fence 103 needs to move over a distance at least great enough for the stapled stack S to fall from the finish tray 400, such a distance may be changed in association with the sheet size. Further, since the front side fence 104 should only be stopped at a level which allows the stack S to pass, it is not necessary to provide an extra space for the side fence 104. After the discharge of the stack S, the side fences 103 and 104 are moved in the same direction as each other to the original position to prepare for another cycle. Alternatively, an arrangement may be made such that, after stapling, the end fences 102 are brought to a predetermined position with no regard to the sheet size, and then the side fences 103 and 104 are moved to discharge the stack S. Then, the stack S will be discharged at a predetermined position by having the edge thereof guided by the end fences 102.

Stapling Section 300

Figure 18:
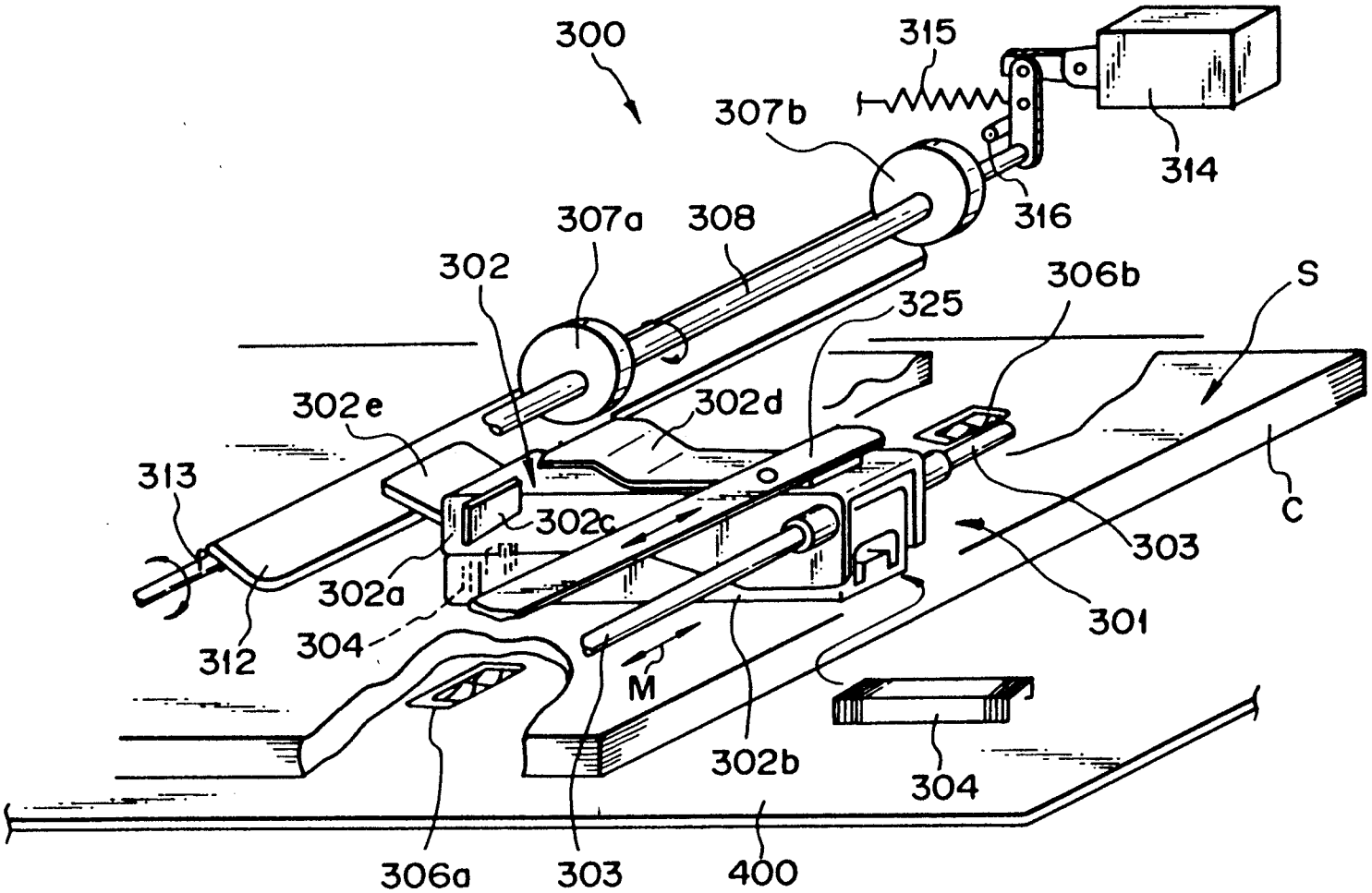
FIG. 18 is a fragmentary perspective view of a stapling section included in the embodiment.

As shown in FIG. 18, the previously mentioned stapler 301 is constituted by the stapler body 302 and seats 306*a* and 306*b* which are located at opposite sides of the finish tray 400. While FIG. 18 shows only two seats, three or more seats may be provided to deal with various sheet sizes. The stapler body 302 has a driving portion 302*a*, a stapler storing portion 302*b*, a flat lug 302*c*, a leaf spring 302*d*, and an arm 302*e*. Staples 304 accommodated in the storing portion 302*b* are driven downwardly, as viewed in the figure, one after another by the flat lug 302*c* of the driving portion 302*a*. The staple 304 so driven out penetrates the sheet stack S having been positioned on the finish tray 400 by the jogging operation. The legs of the staple 304 are bent in a shape complementary to the surface of the seats 306*a* and 306*b*, whereby the stack S is stapled.

The staple 304 is hammered out from the storing portion 302*b* by the rotation of eccentric cams 307*a* and 307*b*. Specifically, the eccentric cams 307*a* and 307*b* are located in a predetermined upper portion of the stapler body 302, as viewed in FIG. 18, and affixed to a rotary shaft 308. If desired, only one eccentric cam or three or more eccentric cams may be mounted on the shaft 308. Usually, the eccentric cams 307*a* and 307*b* are held in a position where they do not contact the driving portion 302*a* (position shown in FIG. 18), on the basis of the output of a sensor or similar implementation, not shown. At the time of stapling, a motor, not shown, causes the shaft 308 to rotate one full rotation via a gearing. As a result, the eccentric cams 307*a* and 307*b* press the leaf spring 302*d*. The resulting reaction of the leaf spring 302*d* rotates the driving portion 302*a* downward about the shaft 308, whereby one staple 304 is driven into the stack S.

The arm 302*e* is affixed to the end of the driving portion 302*a* and engageable with a stapler switching arm 312 which is mounted on a shaft 313. In the event of stapling, the stapler switching arm 312 is rotated clockwise, as viewed in FIG. 18 by a solenoid 314 and thereby spaced apart from the arm 302*e*. As a result, the end of the stapler body 302 falls onto the top of the stack S by gravity. In this position, the stapler body 302 presses the stack S from the above and, therefore, plays the role of a sheet guide for preventing the stack S from being dislocated during stapling. On the other hand, when stapling is not under way, the stapler switching arm 312 is urged counterclockwise by a spring 315 to abut against a stop 316. In such a condition, the stapler body 302 is lifted by the stapler switching arm 312 and spaced apart from the sheets S which will be sequentially stacked on the finish tray 400.

The seats 306*a* and 306*b* are disposed below the eccentric cams 307*a* and 307*b*, respectively, and flush with or positioned below the finish tray 400. Hence, when the stapler body 302 is in the above-stated standby position, sheets are sequentially transported through the gap between the stapler body 302 and the seats 306*a* and 306*b* without being caught by the latter.

The stapler body 302 is affixed to a belt 325 which is movable in a direction indicated by an arrow in FIG. 18. Therefore, the stapler body 302 is capable of stapling the stack S at two positions just above the seats 306*a* and 306*b* due to the rotation of the eccentric cams 307*a* and 307*b*.

Discharging Section 200

Figure 19:
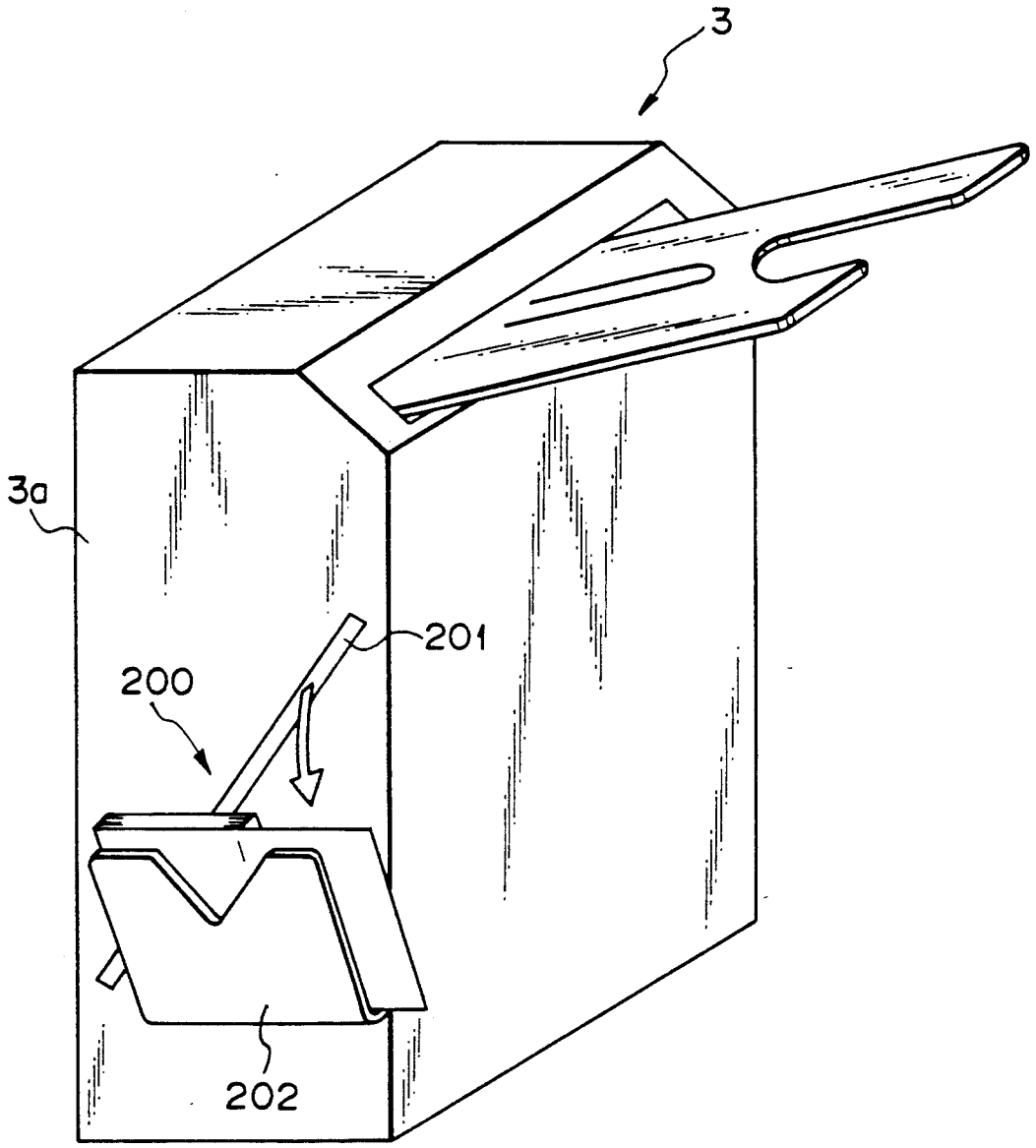
FIG. 19 is a perspective view of a discharging section included in the embodiment.

As shown in FIG. 19, the finisher 3 has a framework 3*a* which is formed with an opening 201 on the front thereof as seen in FIG. 19, i.e., on the operating side. The opening 201 extends in the same direction as the finish tray 400. A tray 202 is supported by the framework 3*a* and located below the opening 201. The stapled stack S on the finish tray 400 is driven out to the tray 202 via the opening 201 by the side fences 103 and 104.

Control 800 of Finisher

Figure 20A:
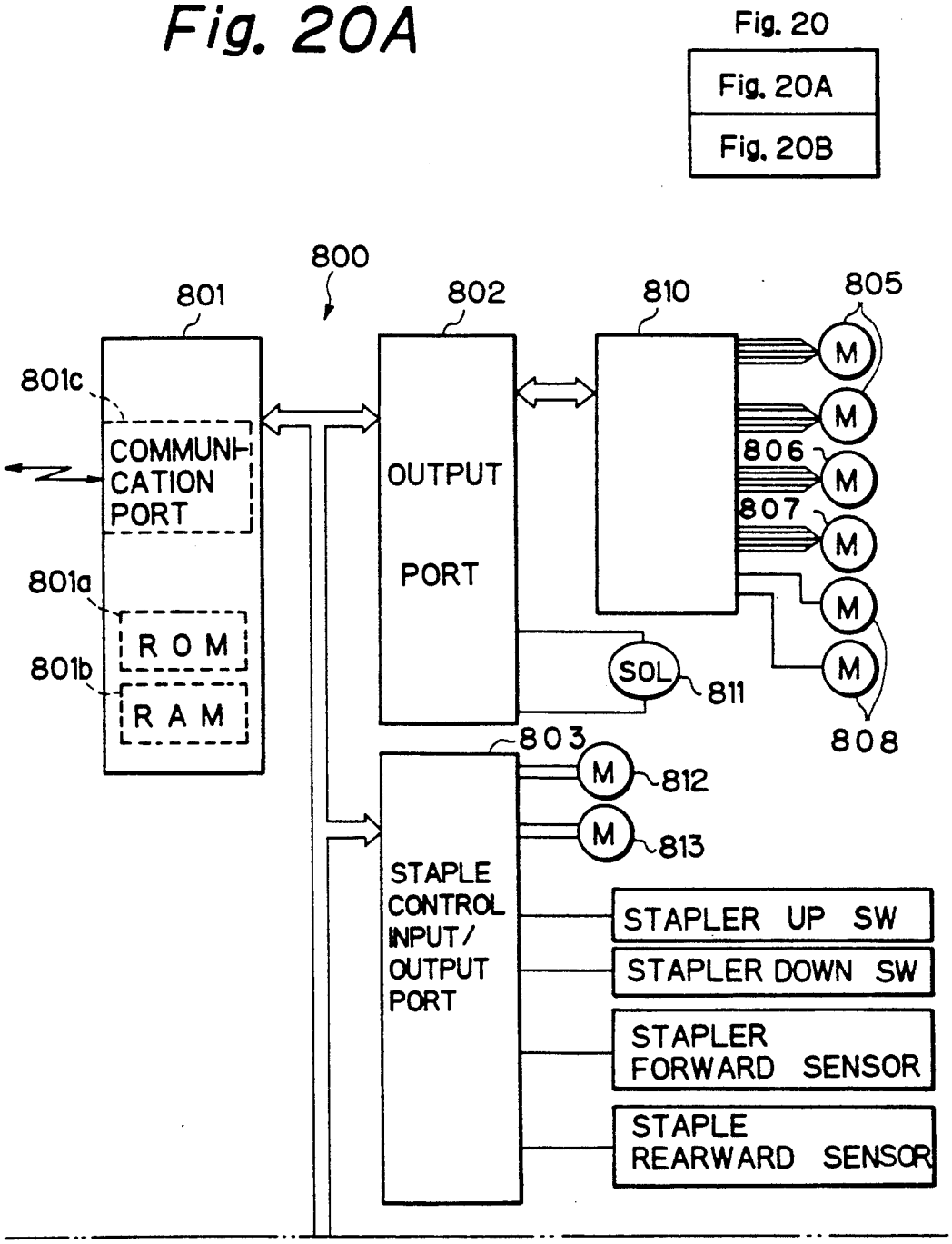
FIG. 20 is a block diagram schematically showing a control incorporated in the finisher of FIG. 1.
Figure 20B:
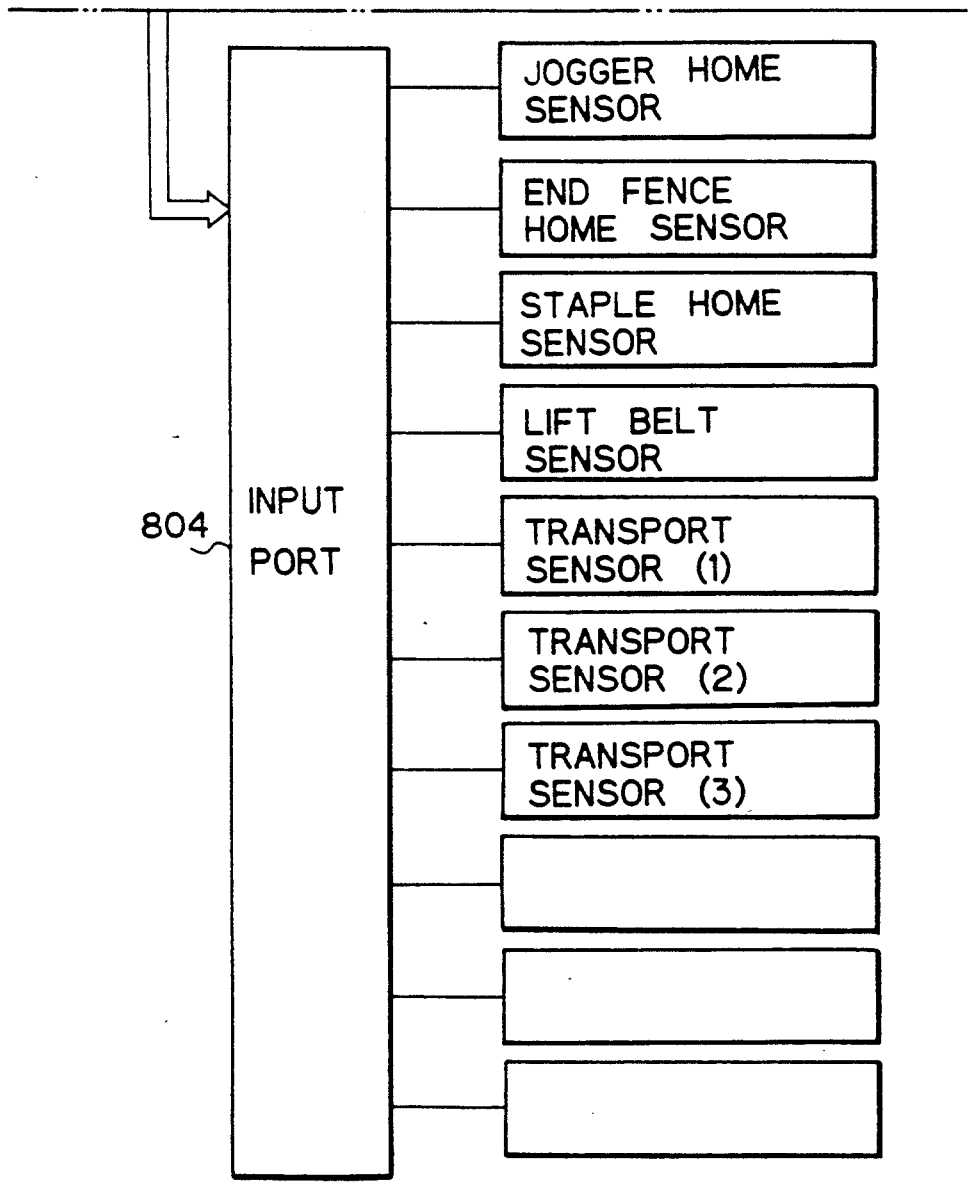
Figure 21:
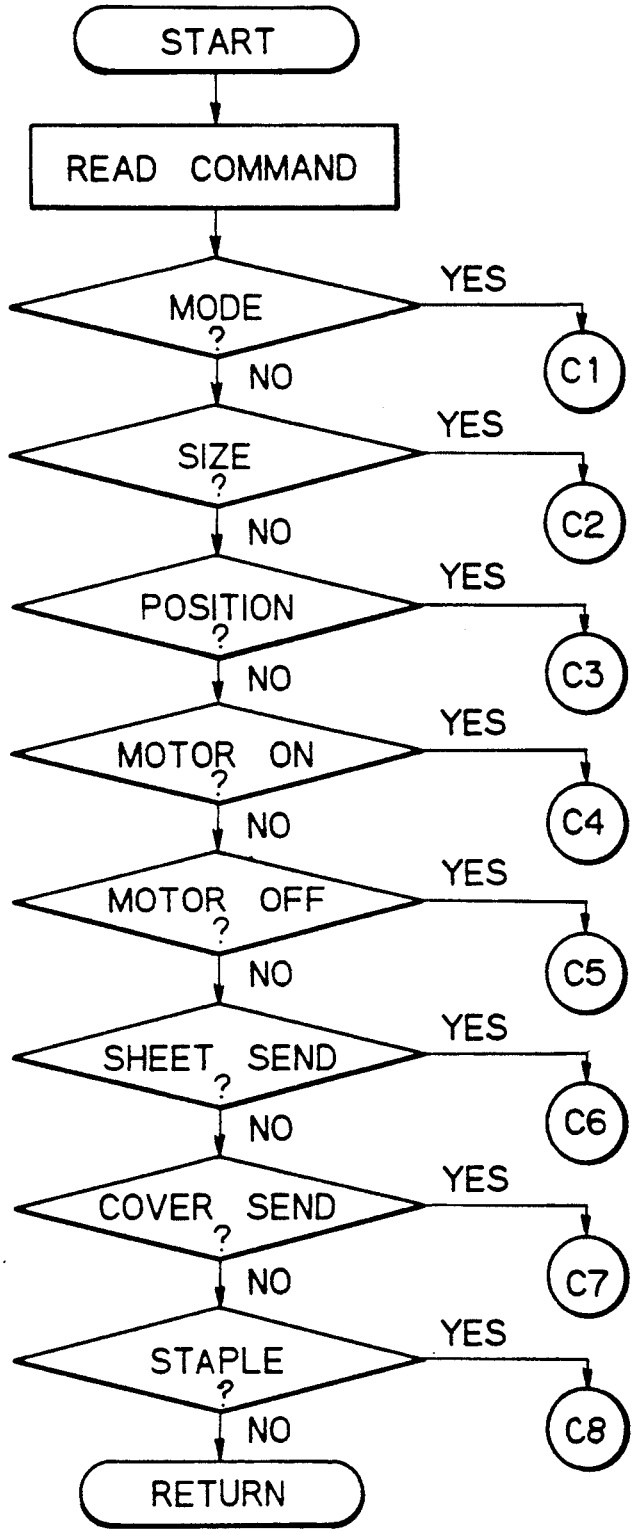
FIG. 21 is a flowchart demonstrating a specific operation of the finisher of FIG. 1 associated with bind commands.
Figure 22:
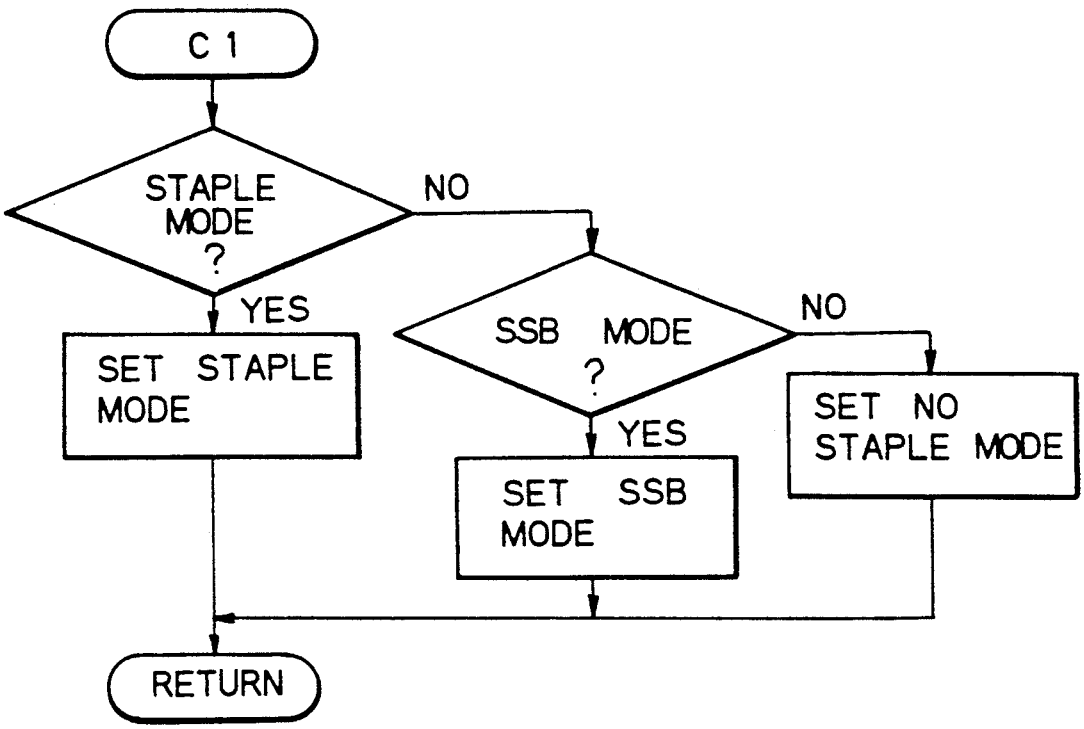
FIGS. 22–29 are flowcharts associated with FIG. 21.
Figure 23:
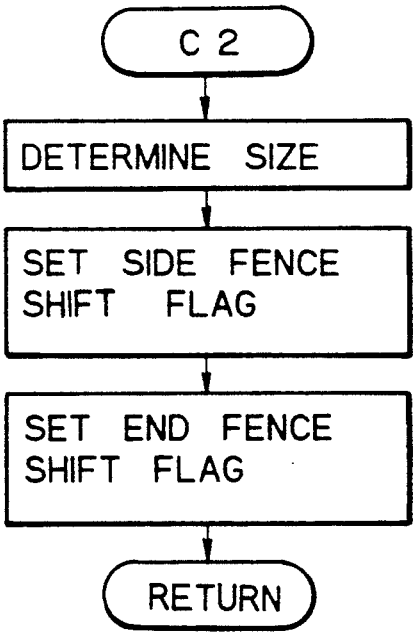
Figure 24:
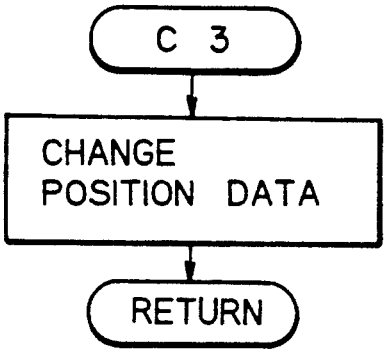
Figure 25:
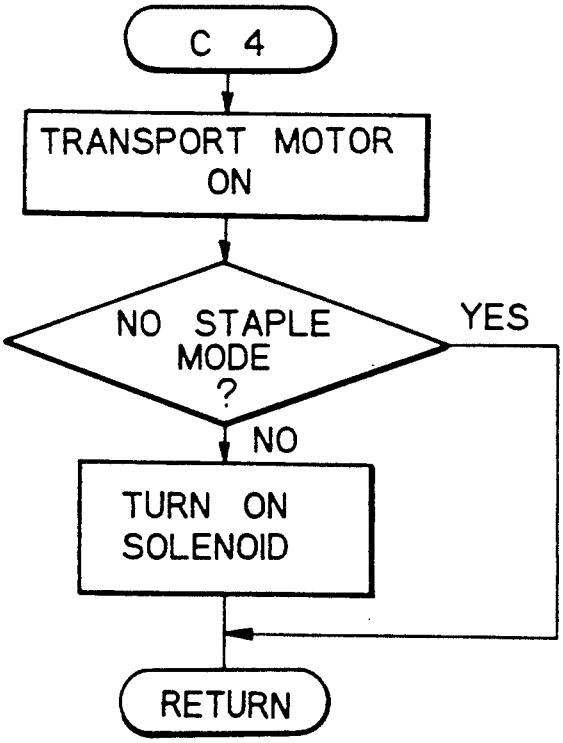
Figure 26:
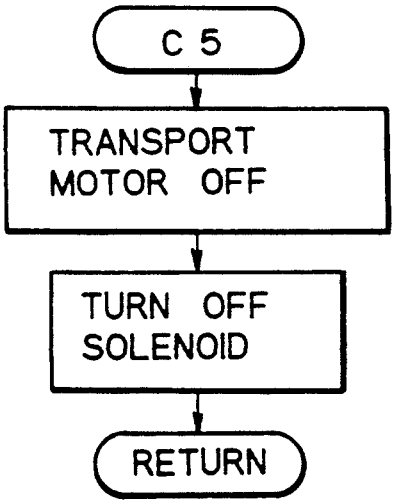
Figure 27:
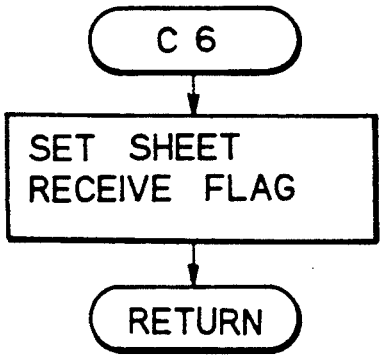
Figure 28:
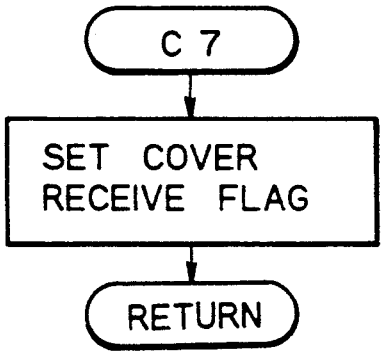
Figure 29:
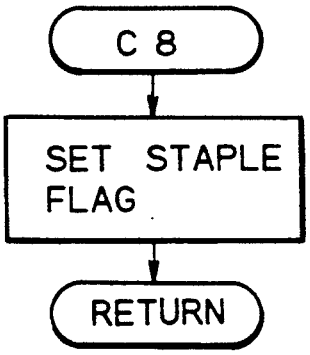

FIG. 20 shows the control 800 of the finisher 3. The construction and operation of the control 800 will be described hereinafter.

(1) Construction

As shown in FIG. 20, a CPU 801 is implemented as a one chip microcomputer having a ROM 801*a*, a RAM 801*b*, and a serial communication port 801*c*. An output port 802, a stapler control input output port 803 and an input port 804 are attached to the CPU 801. On receiving a command from the copier body 1, the control 800 executes a corresponding operation. The commands and their contents will be described later. The output port 802 is connected to a motor driver 810 for driving a jogger motor 805 (corresponding to the side fence motors 110 and 111), an end fence motor 806, a stapler back-and-forth motor 807, a transport roller motor 808, and a lift belt motor 809 at a constant speed. A pawl solenoid 811 and other loads are also driven via the output port 802. A stapler up-and-down motor 812 and a stapler drive motor 813 are connected to the staple control input/output port 803. This port 803 has independent signals necessary for the operation of the stapler. The input port 804 receives information from the home position sensors, transport sensors, etc.

The commands to be sent from the copier body 1 to the control 800 are as follows:

Mode command: staple mode or nonstable mode
Size command: sheet size information
Position command: stapling position information (front-and-rear and left-and-right)
Motor ON command: transport motor ON
Motor OFF command: transport motor OFF
Sheet send command: sheet transport
Cover send command: cover transport
Staple command: stapling Processing to be executed in response to the above commands is shown in FIGS. 21–29.

(2) Operation

The finisher 3 selectively performs the following operations:

steering sheets to the proof tray 905;
steering sheets to the finish ray 400;
positioning sheets;
binding sheets; and
discharging sheets to the tray 202.

The operation of the control 800 will be described specifically.

(i) Tray Selection

The control 800 selects one of the trays to which sheets should be discharged in response to the mode command sent from the copier body 1 at the beginning of a copying operation. Specifically, the control 800 selects one of the no stable mode, ordinary staple mode, and SSB mode as designated by the mode command. The control 800 switches the pawl 902 toward the proof tray 905 if the mode command designates the no staple mode or toward the finish tray 400 if the mode command designates the staple mode or the SSB mode.

(ii) Determining Stapling Position

Figure 30:
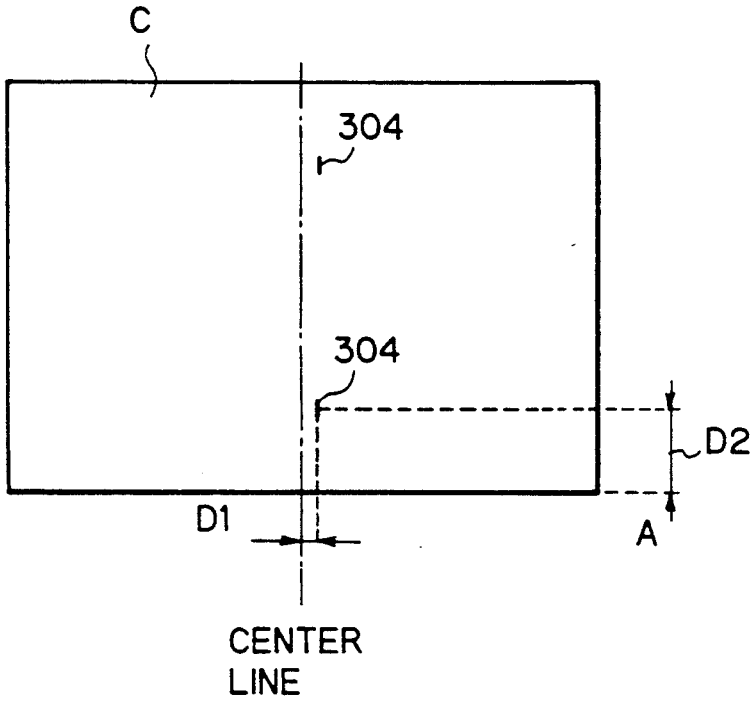
FIG. 30 is a view indicative of the stapling position of the finisher shown in FIG. 1.

In the staple mode, the control 800 controls the finisher 3 such that sheets are sequentially discharged to and stack on the finish tray 400 while being positioned, then stapled as soon as a set of sheets is completed, and then discharged as a stapled stack S. Regarding the stapling position, positions D1 and D2 shown in FIG. 30 are variable on the basis of the position of the end fences 102 and that of the stapler body 302, as instructed by the position command. For this purpose, it is necessary to move the side fences 103 and 104 and end fence 102 to particular positions, as follows. If the mode command sent first is the staple command, the control 800 references a size command sent after the mode command to drive the side fence motors 110 and 111, i.e., the side fences 103 and 104 to positions matching the lengthwise dimension of the sheets. At the same time, the control 800 drives the end fence motor 806 until the end fences 102 reach a position matching the widthwise dimension of the sheets. Since the stapler body 302 is fixed at a position where it faces the end fences 102, the stapling position is determined by the position of the end fence 102. The distance of the stapling position from the edge of the sheets in the lengthwise direction is given by the position command.

(iii) Sheet Discharge to Finish Tray 400

Figure 32:
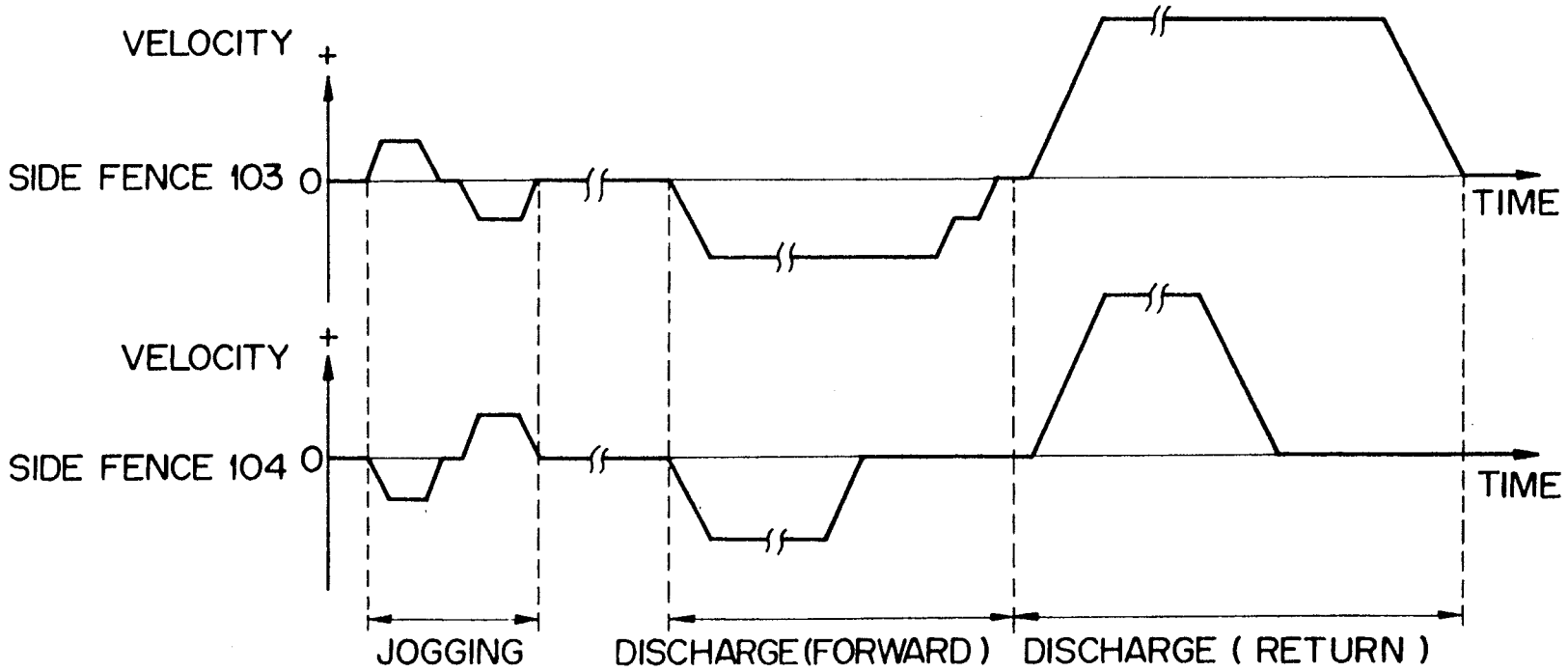
FIG. 32 shows velocity waveforms particular to side fences included in the jogging section of FIG. 14.

In the event of transfer of sheets from the copier body 1 to the finisher 3, the sheet send command is sent in the case of an ordinary recording sheet or the cover send command is sent in the case of a cover sheet, before the feed of a recording sheet. The cover send command also shows that in the event of the SSB mode the size of a sheet to be sent from the copier body 1 is at least twice as large as the previous sheet size. When a recording sheet reaches the finish tray 400, the side fences 103 and 104 are driven in opposite directions by the motors 110 and 111 to position the sheet in the front-and-rear direction. Since the side fences 103 and 104 also plays the role of sheet discharging means which will be described, they are provided with respective drive means. How the side fences 103 and 104 jog is shown in FIG. 15 while the velocity waveforms representative of such jogging movements are shown in FIG. 32.

(iv) Stapling

Figure 31:
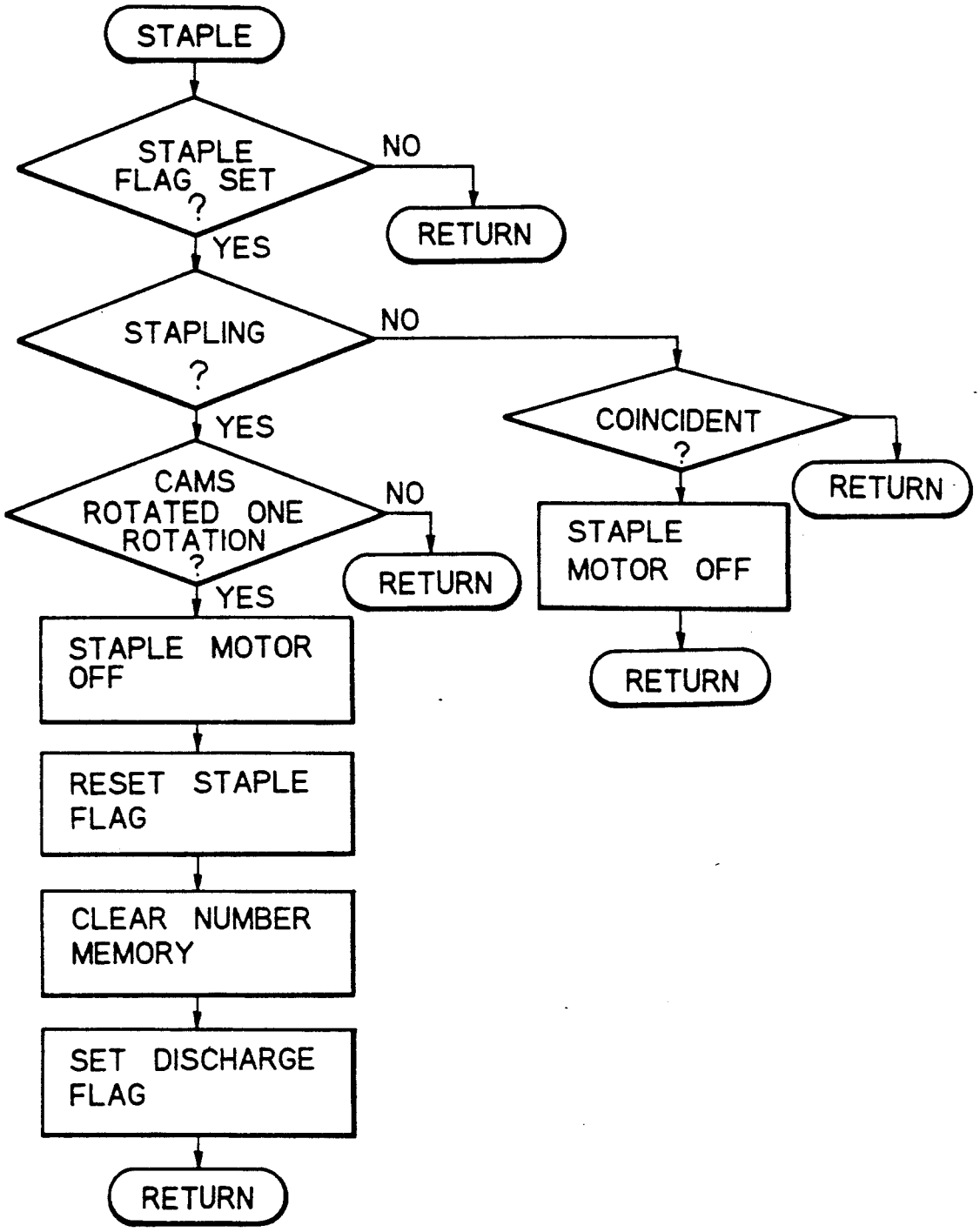
FIG. 31 is a flowchart representative of a specific stapling procedure to be executed by the finisher of FIG. 1.

As shown in FIG. 31, on receiving the staple command from the copier body 1, the control 800 sets a staple flag and then waits until sheets equal in number to the sheet send commands and cover send commands received reach the finish tray 400. As soon as the number of sheets and the number of commands compare equal, the control 800 energizes the stapler drive motor 813 to thereby rotate the eccentric cams 307*a* and 307*b* one rotation. As a result, the stack S is stapled. Thereafter, the control 800 resets the staple flag, clears a number memory which counts the number of sheets reached the finish tray 400, and sets a discharge flag to start on a discharging sequence.

(v) Sheet Discharge

Figure 33:
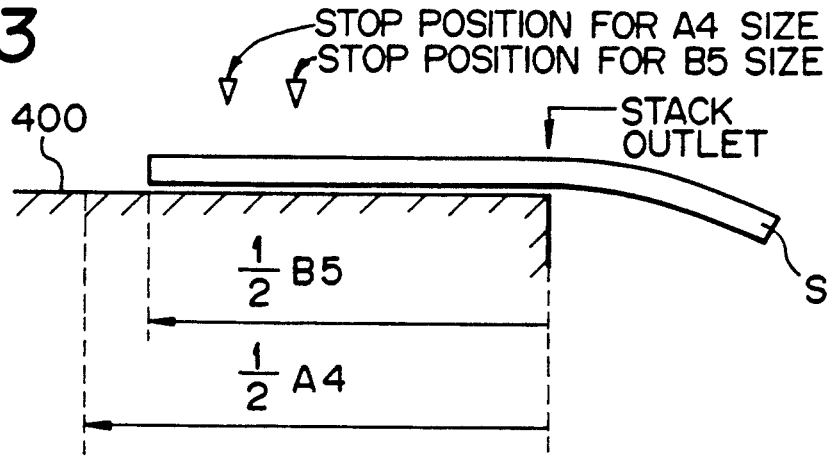
FIG. 33 shows a position where the rear side fence of the jogging section stops.

The stapled stack is discharged by the side fences 103 and 104, as stated earlier. In the velocity waveforms shown in FIG. 32, the portion labeled "DISCHARGE (FORWARD)" is representative of the velocities during sheet discharge. First, the end fence 102 is moved to set up a constant discharge position with no regard to the sheet size, i.e., to bring the trailing edge of the stapled stack S to a predetermined discharge position. Then, the side fences 103 and 104 are moved to convey the stack S toward the front of the device at a constant speed. At this instant, the front side fence 104 is caused to stop moving when it is brought out of the transport path. However, the rear side fence 103 is further moved and once decelerated just before the fall of the stack S. The deceleration is to reduce the shock particular to the fall of the stack S. FIG. 33 shows stop positions each being assigned to a particular sheet size. Changing the stop position as shown in FIG. 33 is successful in enhancing the rapid discharge of the stack S. After the discharge of the stack S, the side fences 103 and 104 are each returned at a higher speed than during the forward movement due to the decrease in load, preparing for the next jogging operation.

The embodiment shown and described has various unprecedented advantages, as enumerated below.

(1) A sheet at least twice as large in size as recording sheets S is laid on the stack S as a cover C. After the stack S and cover C have their one edge accurately positioned, the staple 304 is driven into the stack S from above the cover C at substantially the center of the cover C and then have the legs thereof bent to bind the stack S and cover C together. Hence, only if the cover C is folded in two toward the stack S, both the front and the rear of the stack S are covered by the cover C to provide the stack S with attractive appearance. Since the bent legs of the staple 304 are also concealed by the cover C, they are surely prevented from catching the operator's fingers or similar objects, or being loosened.

(2) High quality binding is achievable only if the cover C is transported to the top of the stack S and then stapled together with the stack S, as stated above. This simplifies the construction of the finisher and reduces the cost.

(3) A bind mode for binding a sheet stack without a cover, a special cover mode for binding a sheet stack with a cover which is at least twice as large in size as the stack, and a cover bind mode for binding a stack with a cover or covers of the same size as the stack are available with the embodiment. Any one of such bind modes matching the application can be selected.

(4) Since stapling at two positions can be automatically selected, it is possible to surely bind a sheet stack while preventing the individual sheets from being dislocated.

(5) The stapler body 302 and the seats 306*a* and 306*b* are located at vertically opposite sides of a sheet stack, so that the stapler 301 can be positioned in the horizontal projected plane of the finish tray 400. The stapler 301, therefore, does not protrude from the side of the finisher and reduces the area for installation, compared to a conventional finisher wherein a stapler is located at the side of the finish tray.

(6) Since the stapler body 302 and the seats 306*a* and 306*b* are physically separate from each other, as stated above, a stapled stack can be discharged at any one of three sides other than the side where the end fences 102 are located, e.g., at the front side of the finisher as in the embodiment.

(7) Since a stapled stack is discharged at the front side of the finisher, the finisher is smaller in widthwise dimension than conventional one having a tray at the side thereof, also reducing the area for installation.

(8) Discharging a stapled stack into the tray 202 at the front of the finisher allows the operator to pick up the stack by a minimum of labor and, therefore, with improved efficiency.

Second Embodiment

A reference will be made to FIGS. 34–38 for describing a second embodiment of the present invention which differs from the previous embodiment in the structure of the finisher 3.

Figure 34:
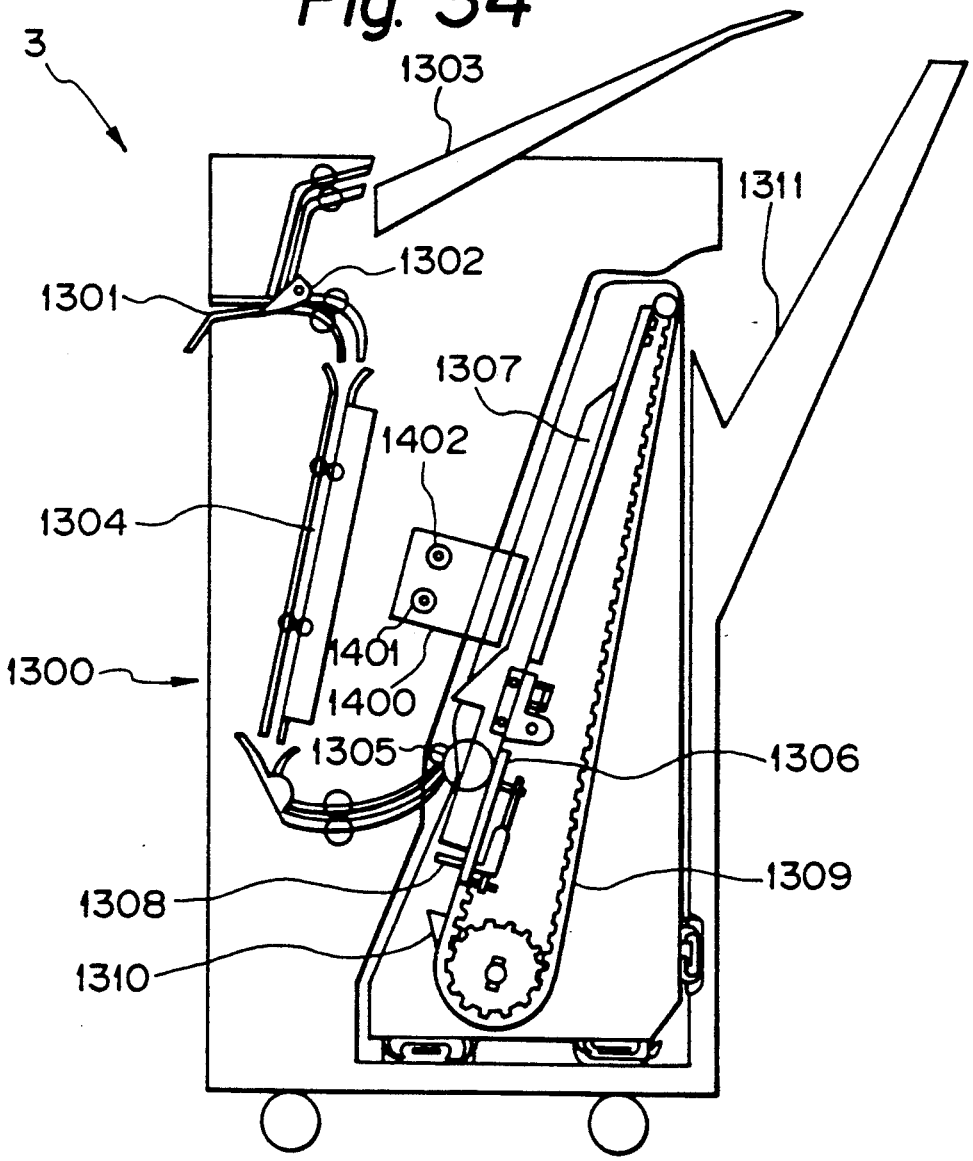
FIG. 34 is a section showing a second embodiment of the present invention.

As shown in FIG. 34, the finisher 3 has a sheet inlet 1301 and a path selector in the form of a pawl 1302. The path selector 1302 steers a sheet coming in through the sheet inlet 1301 to a tray 1303 or to a transport path 1304 which terminates at a finish tray 1306. Transporting means 1300 for driving the sheet to and out of the finish tray 1306 includes a positioning brush 1305, a lift belt 1308 and a lift hook 1310 as well as the sheet inlet 1301, path selector 1302, and transport path 1304. The sheet moved away from the transport path 1304 is positioned by the brush 1305 on the finish tray 1306. The position of the sheet stack S in the up-and-down direction and, therefore, the stapling position in the direction of transport can be adjusted by a back fence 1308.

Figure 35:
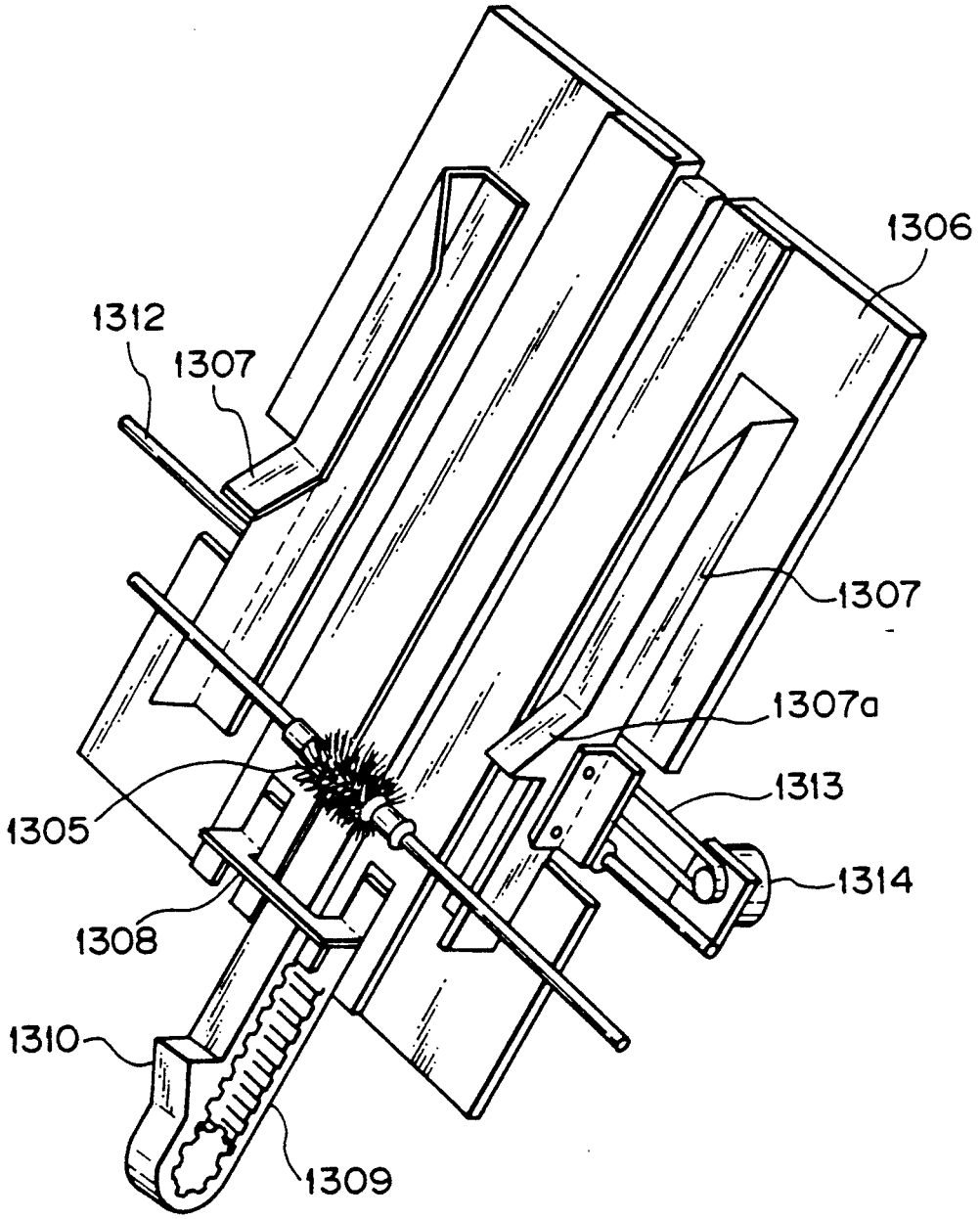
FIG. 35 is a perspective view of a staple tray shown in FIG. 34 together with parts associated therewith.
Figure 36:
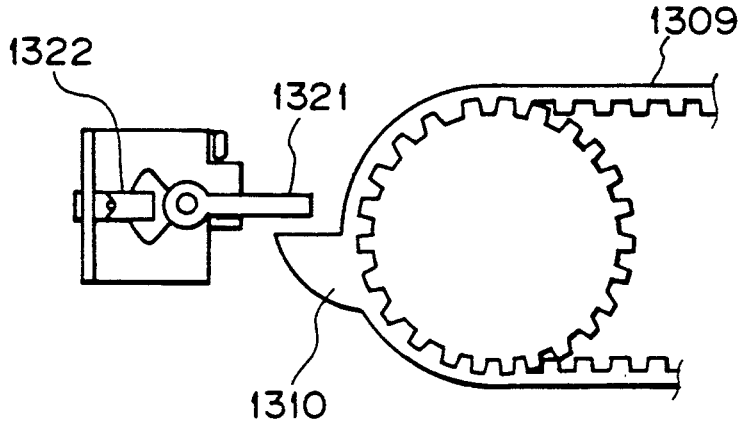
FIG. 36 is a view demonstrating how a lift belt shown in FIG. 34 is positioned.

Specifically, as shown in FIG. 35, the brush 1305, the back fence 1308 and joggers 1307 are arranged around the finish tray 1306. The brush 1305 serves to discharge the sheet onto the finish tray 1306 and urge it against the back fence 1308. Further, the brush 1305 prevents the sheet reached the finish tray 1306 from being pushed up by the following sheet coming out of the transport path 1304. The joggers 1307 are supported by a jogger guide 1312 and connected to a jogger motor 1314 by a timing belt which extends parallel to the jogger guide 1312. As the jogger motor 1314 is rotated, it moves the joggers 1307 to position the sheet in the widthwise direction thereof (front-and-rear direction of the finisher). While the position of each jogger 1307 depends on the sheet size, it is determined by the output of a jogger home sensor, not shown, and the number of pulses which rotate the jogger motor 1314. This is also true with the position of the lift belt 1309. Specifically, as shown in FIG. 36, the lift hook 1310 rotates a rotatable member 1321 to thereby cancel the light intercepting state of an optical sensor 1322, whereby a reference position is determined. At the same time, the pulses driving the belt drive motor are counted.

Figure 37:
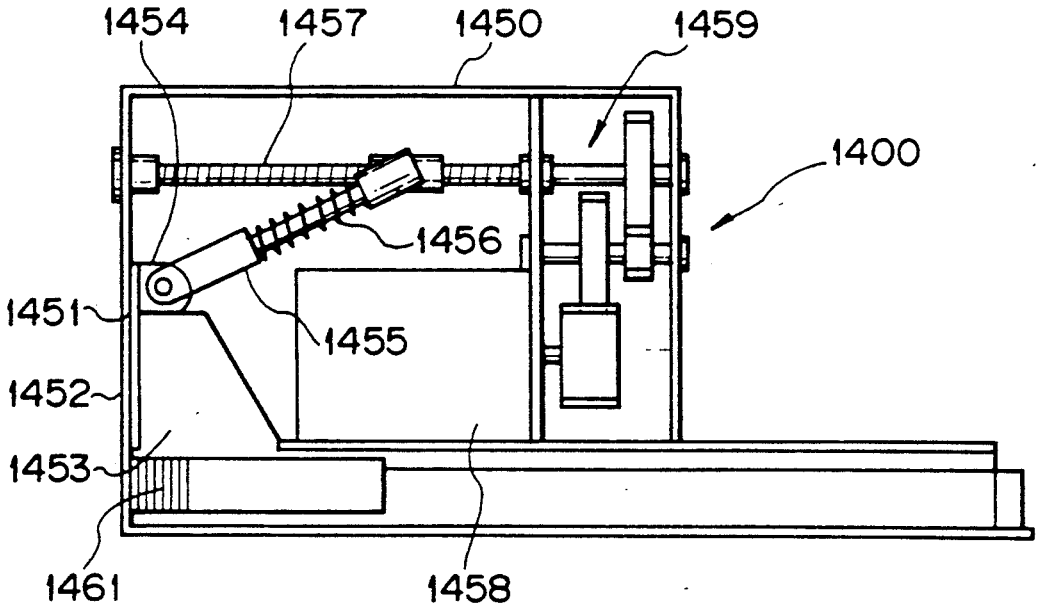
FIG. 37 is a sectional front view of a hammering section included in a stapler unit shown in FIG. 34.
Figure 38B:
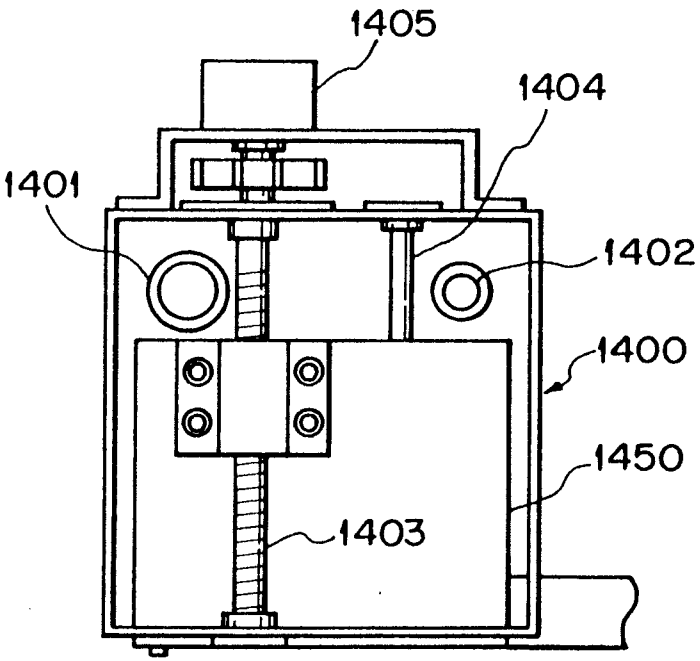
FIGS. 38A and 38B are respectively a sectional side elevation and a sectional front view showing the stapler unit of FIG. 34.
Figure 38A:
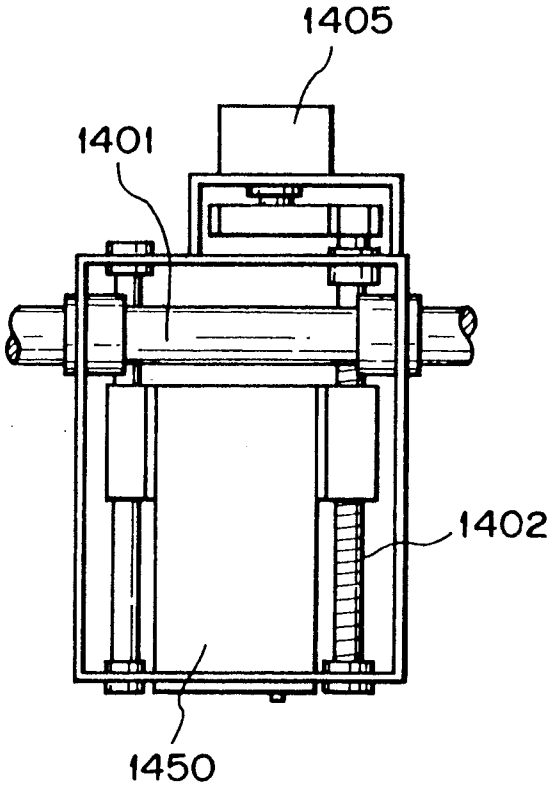

In FIG. 34, a stapler unit (driving portion) 1400 constitutes binding means together with seats (similar to the seats 306*a* and 306*b*), not shown. The stapler unit 1400 is movable back and forth along two stapler guides 1401 and 1402 to staple a sheet stack at a fixed position or positions (e.g. two positions). As shown in FIGS. 37, 38A and 38B, the stapler unit 1400 has thereinside a stapling portion 1450 movable up and down, a slide screw 1403 supporting the stapling portion 1450, a guide rod 1404 along which the stapling portion 450 is movable up and down, and a stapler up-and-down motor 1405 for moving the stapling portion 1450 up and down. In the stapling portion 1450, a hammer member 1451 is interposed between the front end 1452 of the driving portion and a pressing member 1453. The hammer member 1451 is connected to a slide screw 1457 via a connecting member 1454, a lowering arm 1455, and a coil spring 1456. As the slide screw 1457 rotates, the hammer member 1451 is moved in the up-and-down direction to drive a staple 1461. The slide screw 1457 is driven by a stapler motor 1458 via a gearing 1459.

The staple 1461 forced downwardly by the hammer member 1451 penetrates a sheet stack S positioned on the finish tray 1306 by the jogging operation. The legs of the staple 1461 are bent by the previously mentioned seat to thereby staple the stack S. The stack S stapled together with a cover C by the stapler unit 1400 is lifted within the finish tray 1306 by the lift hook 1310 affixed to the lift belt 1309 and then discharged to a stapler discharge tray 1311.

The second embodiment described above has the following advantage in addition to the advantages of the first embodiment. The stapler unit 1400 is movable back and forth along the two stapler guides 1401 and 1402 and, therefore, capable of stapling a sheet stack at any desired positions in the binding margin. Usually, the embodiment automatically selects two-position stapling and, therefore, binds a sheet stack in a neat configuration.

Third Embodiment

Referring to FIG. 39–47, a third embodiment of the present invention will be described which is applicable to, among others, a digital copier and differs from the first and second embodiments in the construction of the finisher.

Figure 39:
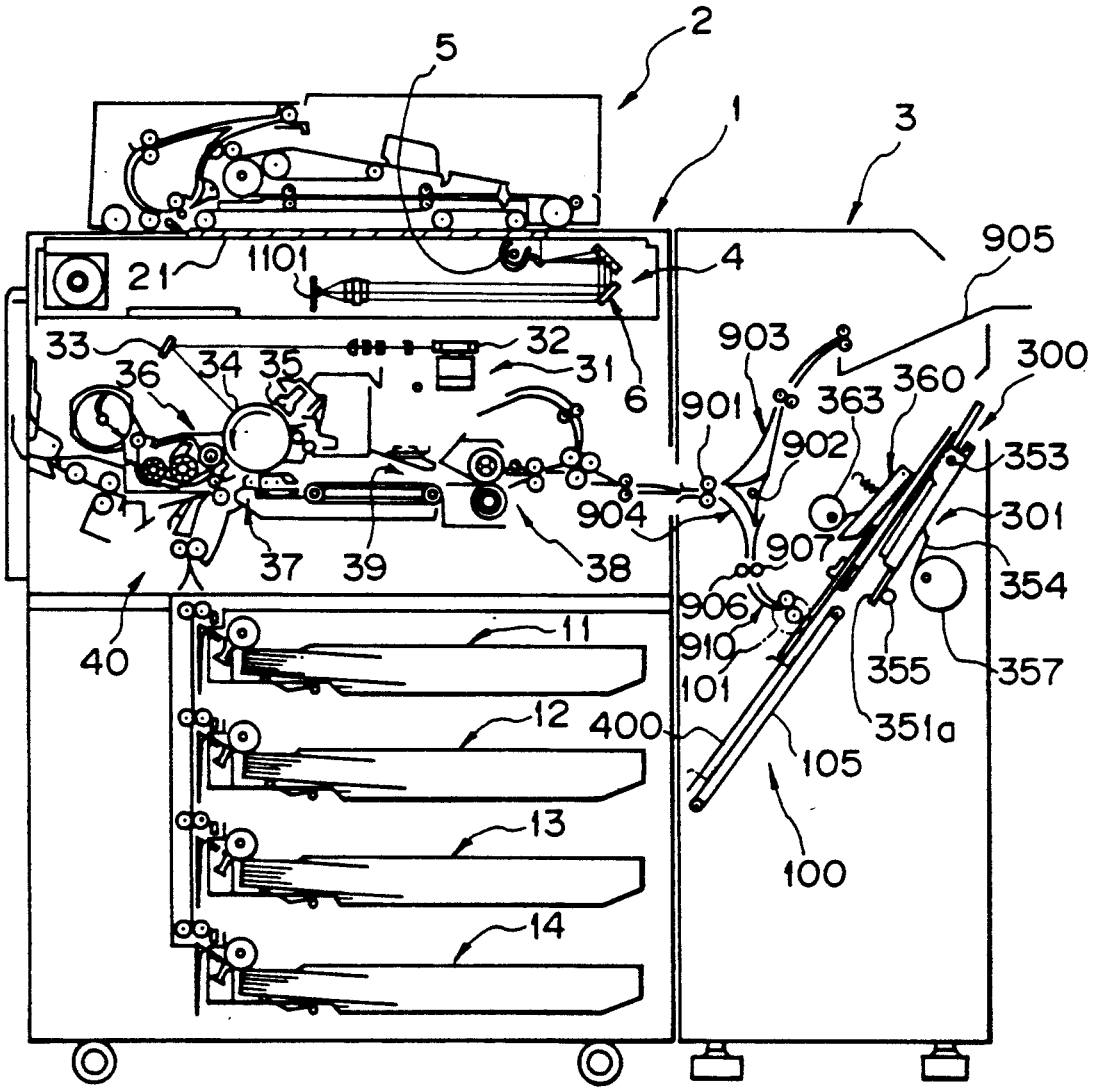
FIG. 39 is a section showing the general construction of a digital copier implemented with a third embodiment of the present invention.
Figure 40:
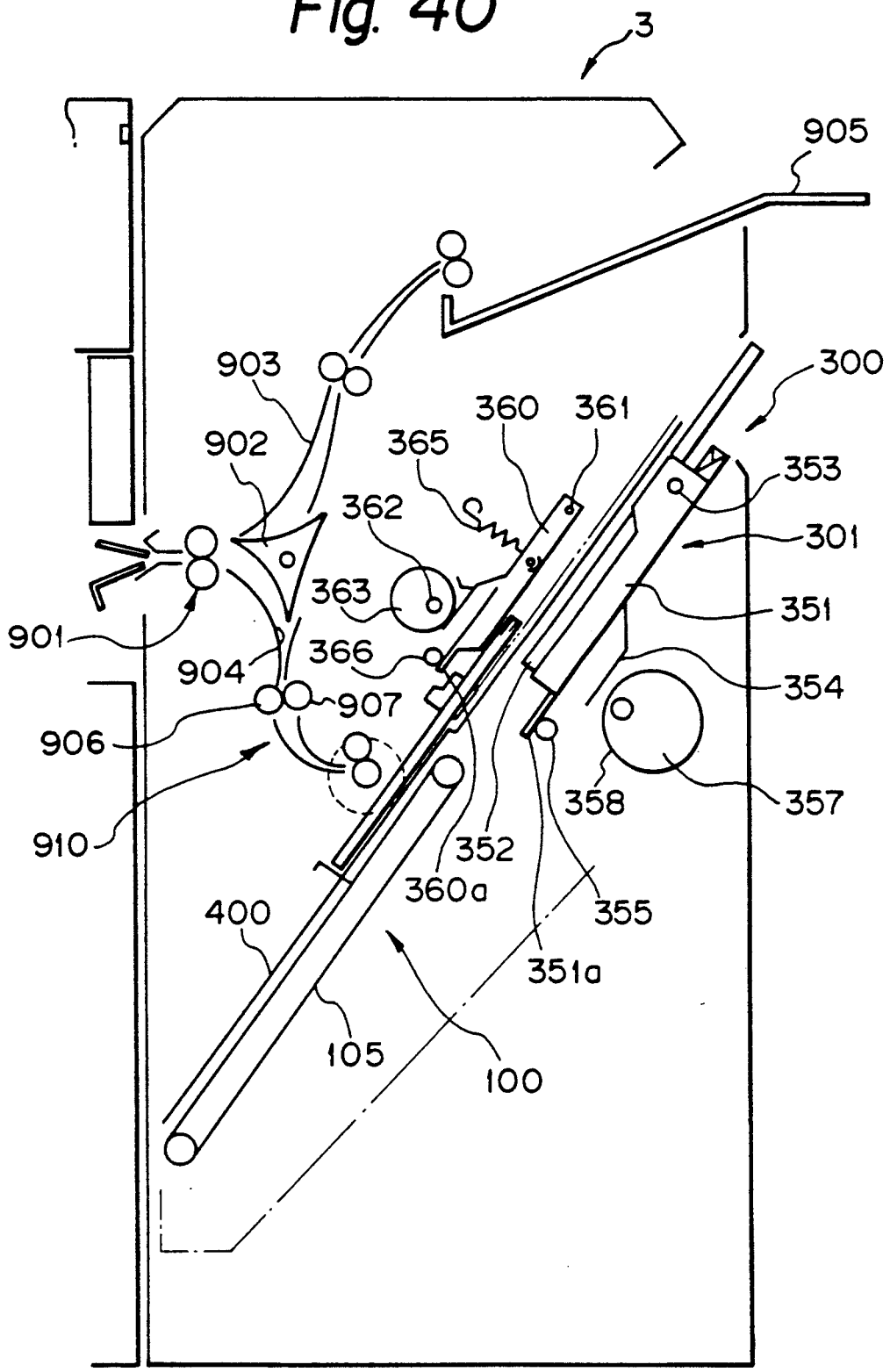
FIG. 40 is an enlarged sectional front view of a finisher shown in FIG. 39.
Figure 41:
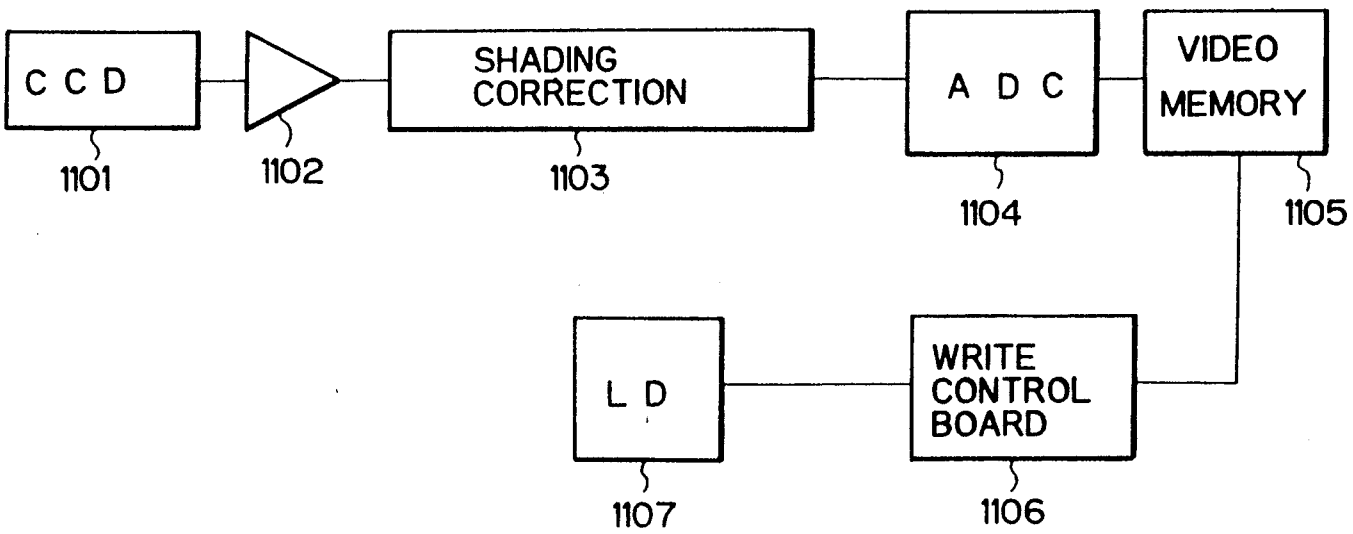
FIG. 41 is a block diagram schematically showing an image signal processing circuit incorporated in the copier of FIG. 39.

As shown in FIG. 39, this embodiment also has the RADF 2 on the top of the copier body 1 and the finisher 3 at the right-hand side of the copier body, as viewed from the front. As shown in FIGS. 39–41, as a document fed by the RADF 2 is set on a glass platen 21, the copier body 1 illuminates it with a light source (fluorescent lamp) 5 included in an image reading section 4. The resulting reflection from the document is propagated through an optical path 6 including mirrors and a lens to a CCD (Charge Coupled Device) array 1101. As shown in FIG. 41, the CCD array 1101 convers the incident reflection to an electric signal and feeds the electric signal to an amplifier 1101. The output of the amplifier 1102 is applied to a shading correction circuit 1103. The shading correction circuit 1103 corrects distortions of the input signal, i.e., image signal ascribable to the change in the quantity of light issuing from the light source 5 and the dark current of the CCD array 1101. The output of the shading correction circuit 1103 is converted to an 8-bit digital signal by an ADC 1104. The digital signal is written into a video memory 1105 and then transferred to a write control board 1106. A laser diode 1101 is included in laser optics 31 and emits a beam in response to a signal from the write control board 1106. The beam from the laser diode 1101 is converted to a parallel beam by a collimator lens, not shown, and then incident to a polygonal mirror unit 32 via beam shaping optics. The beam steered by the polygonal mirror unit 32 scans a photoconductive drum 34 via an f-theta lens, optics, not shown, for compensating for the irregularity of the configuration of the unit 32, and a mirror 33. As a result, a latent image is electrostatically formed on the surface of the drum 34 which has been uniformly charged by a main charger 35. A developing section 36 develops the latent image by a toner. The resulting toner image is transferred to a sheet fed from particular one of sheet cassettes 11–14 incorporated in the copier body 1. The toner image on the sheet is fixed by a fixing section 38.

The video memory 1105, write control board 1106, laser diode 1107, charger 35, drum 34, developing section 36, image transferring and sheet separating section 37 and fixing section 38 constitute an image recording section 40 for recording an image on a sheet on the basis of the image data generated by the CCD array 1101. In the image recording section 40, the sheet is transported along a path 39 extending from the position between the drum 34 and the image transferring and sheet separating section 37 to the fixing section 38 to be transferred from the copier body 1 to the finisher 3. The sheets accommodated in any one of the sheet cassettes 11–14, e.g., cassette 14 are cover sheets which may be ordinary sheets of A3 size or sheets different in size (lengthwise dimension) from ordinary sheets.

Figure 42:
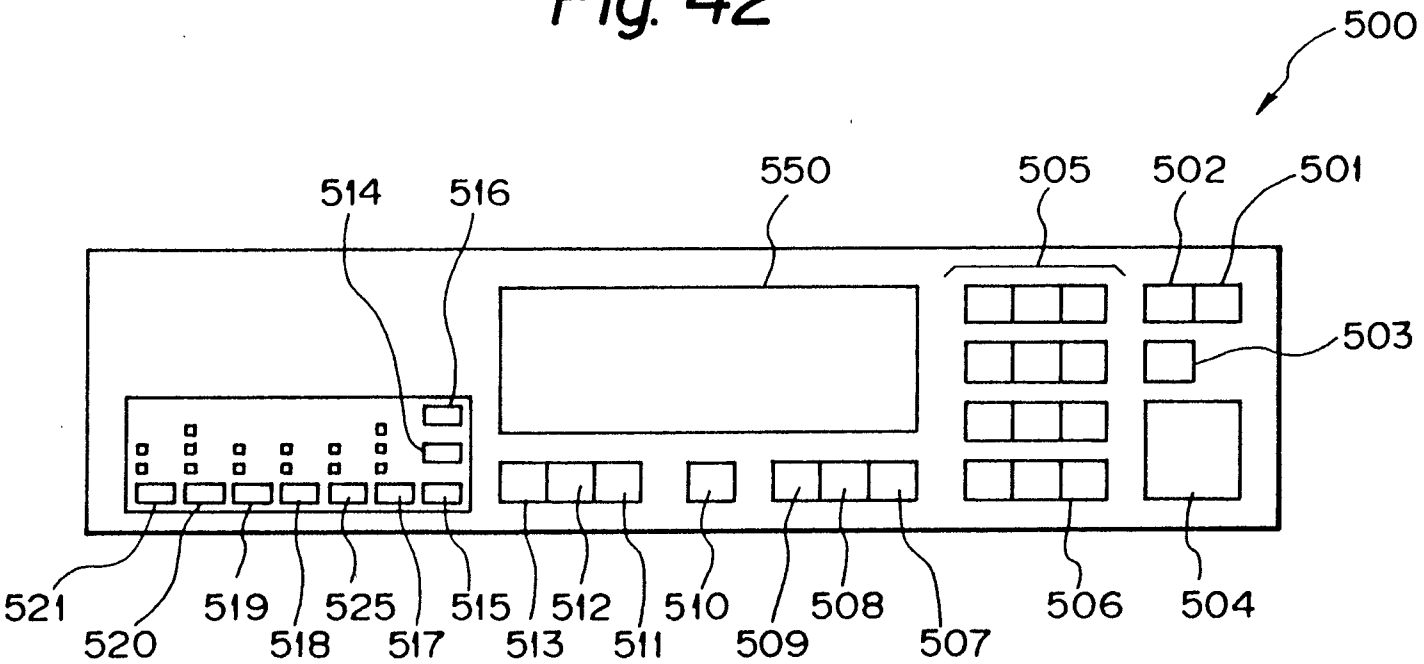
FIG. 42 is a plan view of an operation and display panel included in the embodiment of FIG. 39.
Figure 43:
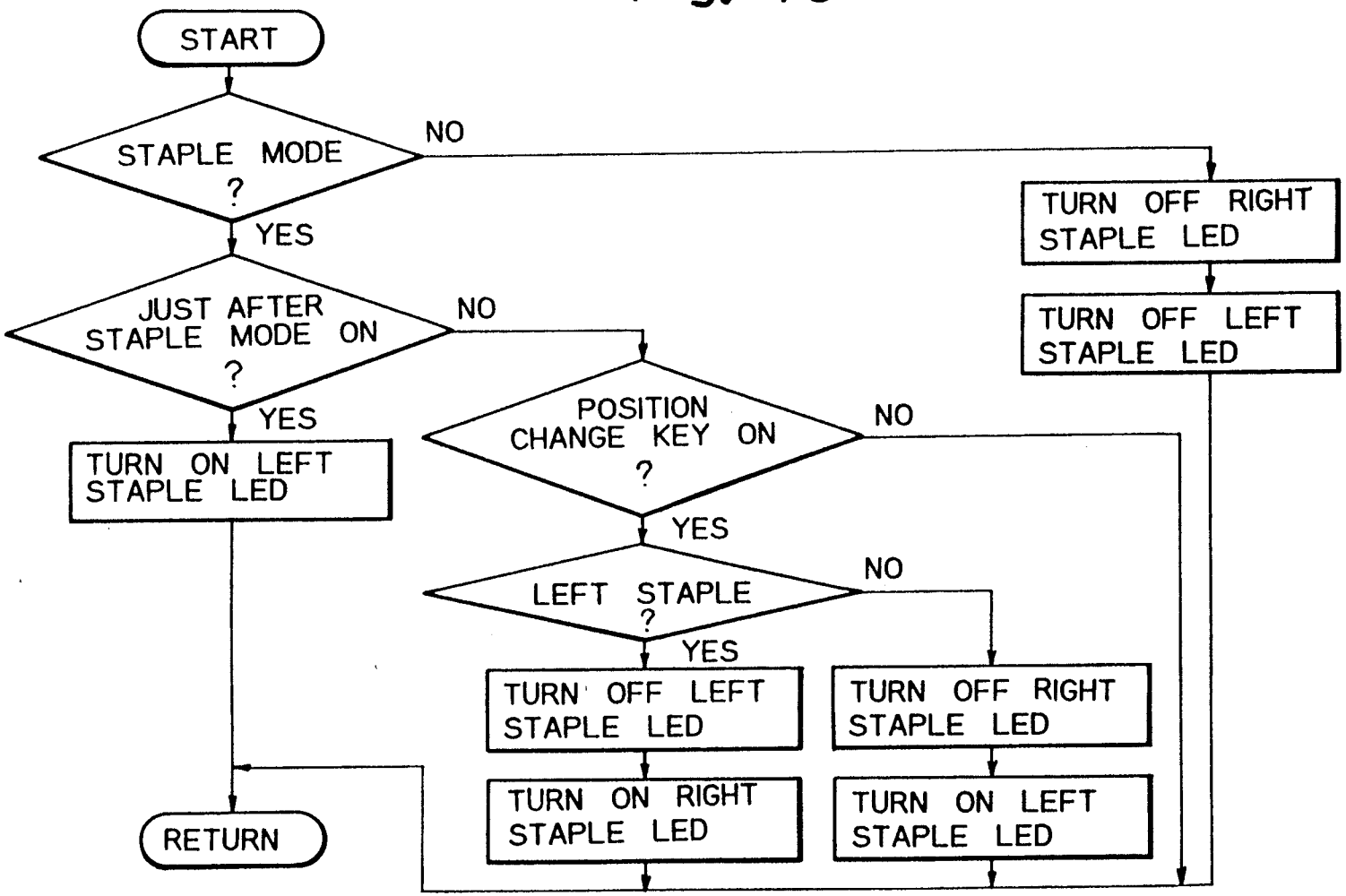
FIG. 43 is a flowchart demonstrating a specific operation of the third embodiment for setting up and changing a right or a left binding position.

The recording sheet carrying an image and driven out of the copier body 1 is transported to the downstream side by the roller 901 of the finisher 3. The path selector or pawl 902 steers the sheet to either of the first and second transport paths 903 and 904. The sheet entered the transport path 903 is discharged to the proof tray 905 while the sheet entered the transport path 904 is conveyed to the finish tray 400 by transporting means 910. The transporting means 910 is constituted by rollers 906 and 907 arranged on the second transport path 904 as well as the roller 901, path selector 902, and transport path 904. The transporting means 910 transports sheets and stacks a plurality of sheets on the finish tray 400. The operation and display panel 500, FIG. 42, is mounted on the top of the copier body 1 at the operating side.

The various sections of the finisher 3 will be described specifically together with the operation and display panel 500 of the copier body 1 and the RADF 2.

Operation and Display Panel 500

The operation and display panel 500 is essentially the same as the panel 500 and LCD section 550 shown in FIGS. 2 and 3 except that it has an additional key 525 which may be used to change the stapling position as will be described. The procedures described with reference to FIGS. 5–8 are also true with the panel 500 of this embodiment.

Figure 44A:
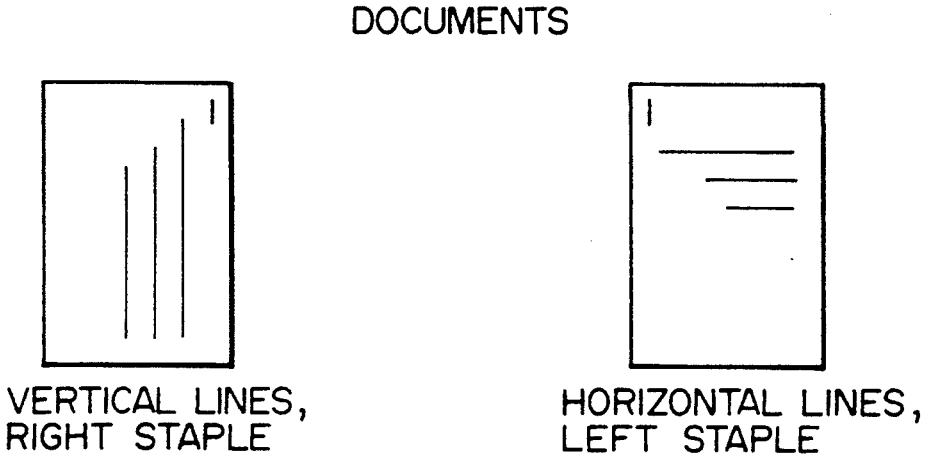
FIG. 44A shows two different kinds of documents.
Figure 44B:
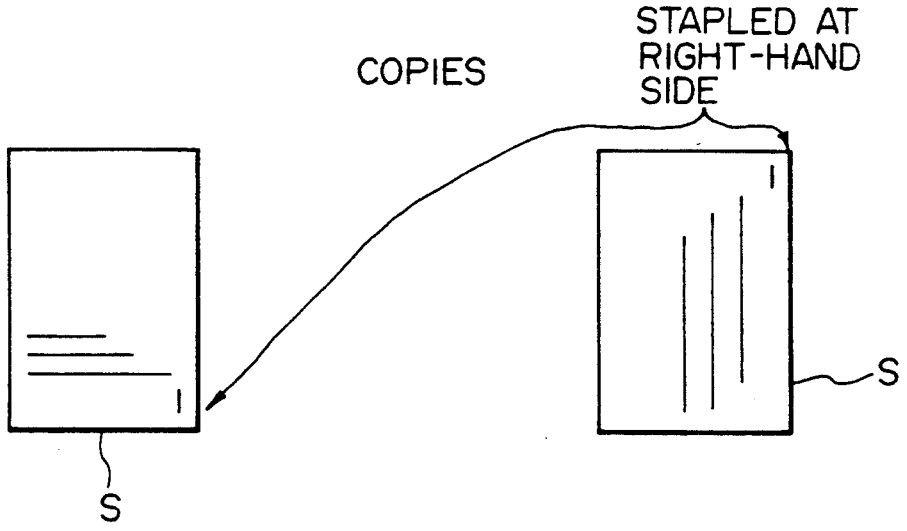
FIG. 44B shows stapled sheets associated with the documents of FIG. 44A.
Figure 45:
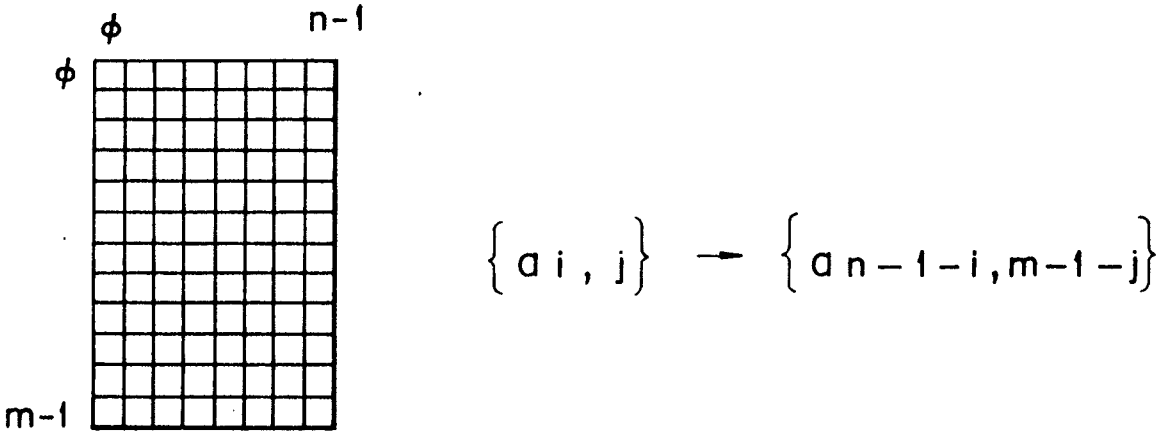
FIG. 45 shows a procedure for rearranging pixel data in order to rotate an image to be recorded.

With this embodiment, it is possible to select, in the SSB mode, either of a right and a left stapling position depending on the kind of the documents, i.e., documents with image information written in vertical lines (needing stapling at the right-hand side) or documents with image information written in horizontal lines (needing stapling at the left-hand side). For this purpose, a control, not shown, incorporated in the copier body 1 executes a sequence of steps shown in FIG. 43 every predetermined period of time, so that the selection may be executed when the position change key 525 is pressed. Specifically, in the staple mode, the control turns on an LED indicative of horizontal lines and left stapling immediately after the staple mode has been set up. Subsequently, when the position change key 525 is pressed, the control determines the desired stapling position and reverses it in the right-and-left direction. To change the stapling position, the control rotates an image to be recorded in a sheet 180 degrees by the image recording section 40, as shown in FIG. 44A and 44B. For example, the control changes the order of data transfer from the video memory 1105 to the write control board 1106 or rearranges the data in the video memory 1105 as shown in FIG. 45. In FIG. 45, assuming that a predetermined image area is made up of $n \times m$ pixel data $a_{i,j}$ (i and j being respectively a number of 0 to $(n-1)$ and a number of 0 to $(m-1)$), the data $a_{i,j}$ are rearranged to $a_{n-1-i,\ m-1-j}$ to rotate the image 180 degrees. When the capacity of the video memory 1105 is short of one full picture, the document reading section 4 may read a document in the opposite direction to rotate the image 180 degrees. Specifically, while the document reading section 4 usually reads an image from the edge of the glass platen 21 toward the center, it may read it from the center of the glass platen 21 toward the edge when the capacity of the video memory 1105 is short. Then, the document shown in FIG. 44A, for example, will be rotated 180 degrees.

As stated above, the position change key 525 plays the role of format information inputting means for indicating whether image data to be entered into the copier body 1 is in vertical lines or in horizontal lines. In response to such information, the image recording section 40 of the copier body 1 rotates the image to be recorded 180 degrees to thereby change the stapling position in the right-and-left direction.

RADF 2

The RADF 2 is constructed and operated in substantially the same manner as the RADF 2 described with reference to FIGS. 9–12, except fo the control over document transport.

Figure 46:
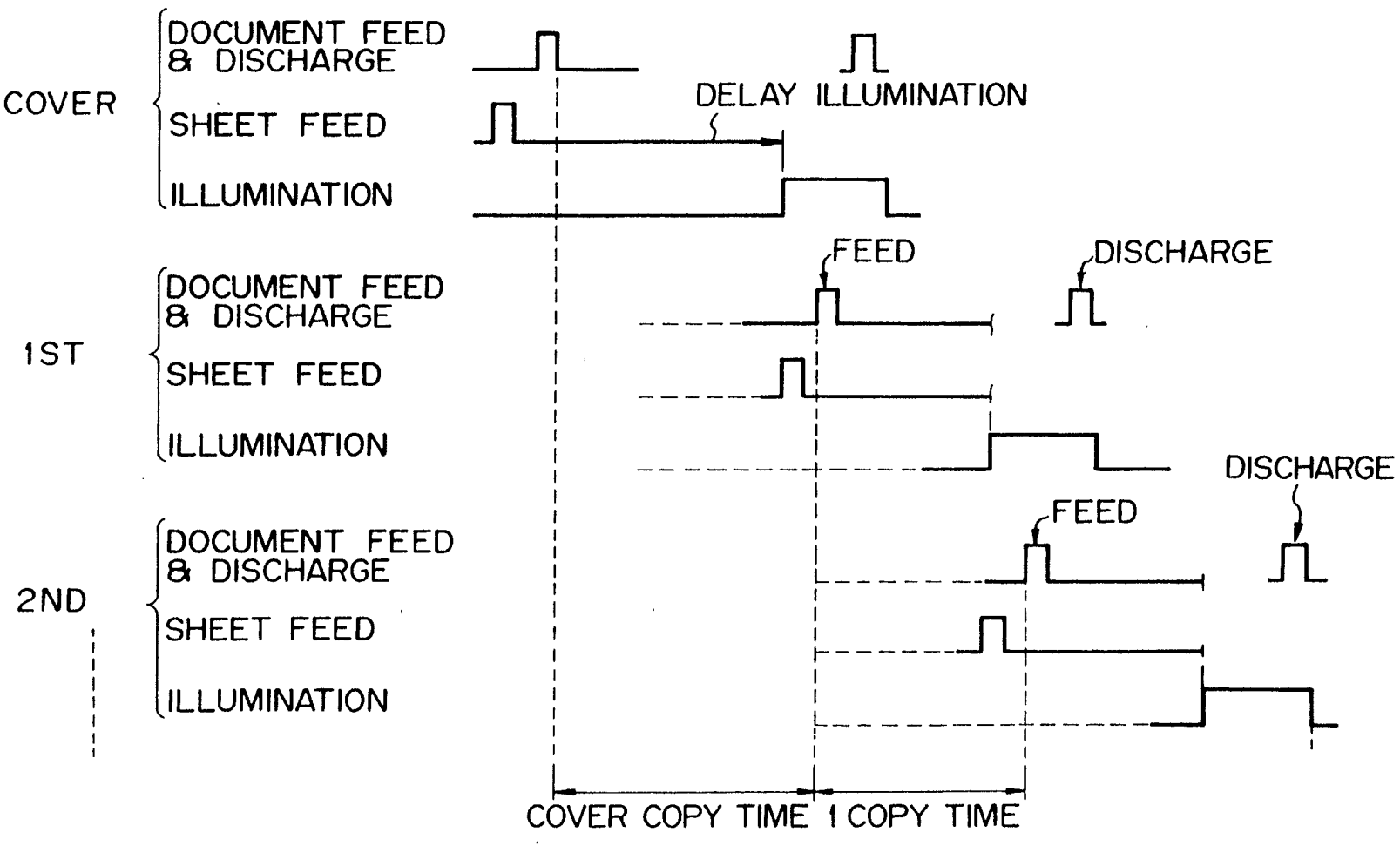
FIG. 46 is a timing chart representative of the document feed and discharge timings, sheet feed timing, and illumination timing particular to the third embodiment.

Specifically, the RADF 2 is loaded with a stack of documents face down and feeds the first document first. Therefore, if the document stack includes a cover, the cover will be copied first. FIG. 46 shows the document feed timing, sheet feed timing, illumination timing, and document discharge timing.

First, before the feed of a cover document, a cover sheet for reproducing it is fed from the sheet cassette 14 at a predetermined timing. The cover document fed by the RADF 2 begins to be illuminated at a delayed timing such that the cover document is reproduced in the latter half (rear half in the direction of transport) of the cover sheet. It is to be noted that the cover document is set on the glass platen 21, FIG. 39, before the illumination. After the illumination, the cover document is immediately discharged by the document belt. The next document (corresponding to the first page) begins to be fed before the discharge of the cover document and then begins to be illuminated at a timing which allows the image thereof to coincide with a recording sheet. Of course, the recording sheet for reproducing such a document is fed from one of the sheet cassettes 11–13 and not from the cassette 14. After the illumination, the document is immediately driven by the document belt while the image is recorded in the sheet. The resulting copy is laid on the above-mentioned latter half of the cover sheet. The above procedure is repeated with all the other documents. When the document to be reproduced is the last document as indicated by the pawl sensor 610, FIG. 12, the cassette to be used is changed after the first set of copies has been produced and before the start of production of the second set of copies. Dealying the illumination as stated above is one approach to record a cover image. Alternatively, an arrangement may be made such that a cover document is transported to a position corresponding to the above-mentioned latter half on the glass platen 21 beforehand, then illumination is effected over the entire area, and then the former half is erased by an eraser. Preferably, the document transport and illumination should be accelerated in the region corresponding to the former half of the cover document.

Jogging Section 100

The jogging section 100 of the embodiment is constructed and operated in essentially the same manner as the section 100 described with reference to FIGS. 14–17 and, therefore, will not be described to avoid redundancy.

Stapling Section 300

Figure 47:
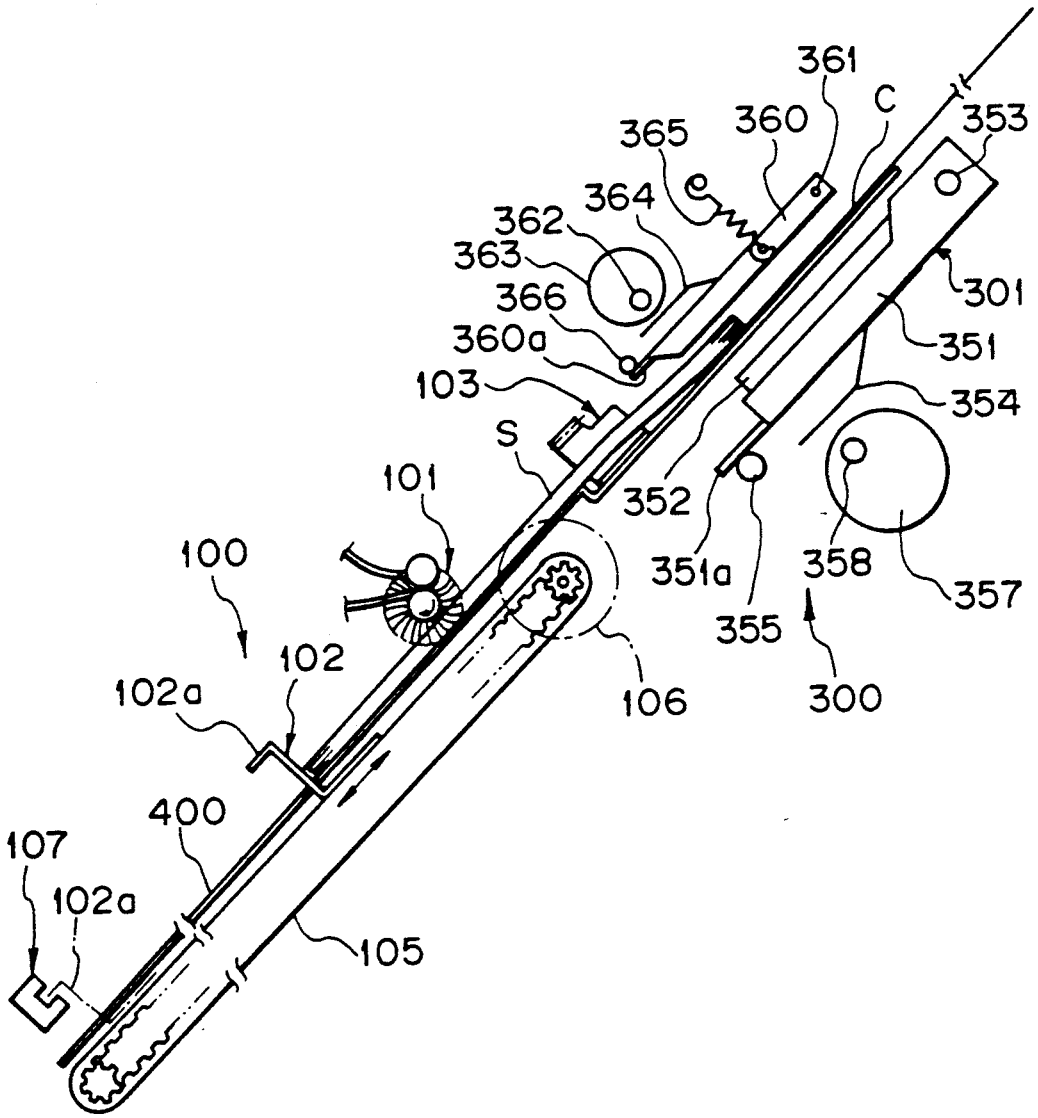
FIG. 47 is a fragmentary perspective view of a jogging section included in the third embodiment.

As shown in FIGS. 39, 40 and 47, the stapler 301 has a hammering section 351 and a seat 360 which are physically separate from each other and located on opposite sides of the finish tray 400. If desired, a plurality of seats 360 may be incorporated in the stapler 301. The hammering section 351 has a hammer portion, not shown, a lug 351*a*, a staple storing portion 352, and a leaf spring 354. The hammering section 351 is rotatably mounted on a shaft 353 and held in a halt with a lug 351*a* thereof abutting against a stop 355 by gravity. A front and a rear eccentric cam 357 (only one is shown) are disposed below the hammering section 351, as viewed in FIG. 40, and affixed to a rotary shaft 358. A single eccentric cam or three or more eccentric cams may be provided, if necessary. Usually, each eccentric cam 357 is held in a halt at a position where it does not contact the leaf spring 354 (see FIGS. 40 and 47), on the basis of the output of a sensor, not shown. In the event of stapling, a motor, not shown, rotates the shaft 358 one rotation via a gearing with the result that the eccentric cams 357 press the leaf spring 354. Then, the hammering section 351 is urged upwardly about the shaft 353 by the reaction of the leaf spring 354. Subsequently, a hammer member, not shown, forces staples, not shown, out of the storing section 352 one by one. The staple penetrates a sheet stack S neatly positioned on the finish tray 400 by the jogging operation, and the legs of the staple are bent by the seat 360 to staple the stack S.

The seat 360 is rotatably mounted on a shaft 361 and constantly biased upwardly by a tension spring 365. The seat 360 has a lug 360*a* and a leaf spring 364 which is urged against an eccentric cam 363 by the spring 365. As the eccentric cam 363 is rotated by the shaft 362, the seat 360 is rotated downwardly against the action of the spring 365 to approach or contact the sheet stack S. When the lug 360*a* of the seat 360 is held in the position where it abuts against the stop 366, the seat 360 is spaced apart from the finish tray 400 by a predetermined distance and, therefore, does not catch the leading edge of a sheet entering the finish tray 400. The shaft 362 and eccentric cam 363 are rotated substantially at the same time as the eccentric cams 357 to perform a predetermined stapling operation.

As stated above, in this embodiment, the eccentric cams 357 are driven in association with the sequence of steps of transporting a sheet to the finisher 3, positioning it on the finish tray 400, stapling a stack of such sheets, and discharging the stapled stack, whereby the hammering section 351 and seat 360 are moved toward and away from each other. When the hammering section 351 and seat 360 are spaced apart from each other, they are prevented from interfering with a sheet even if the sheet enters the finish tray 400 at a high speed. To enhance rapid stapling, the hammering section 351 and seat 360 may be positioned close to (or even contact) the stack S so long as they do not obstruct the jogging operation.

Discharging Section 200

The discharging section 200 is identical with the discharging section 200 of FIG. 19 and, therefore, will not be described to avoid redundancy.

Control 800 of Finisher

The control 800 incorporated in the finisher is the same as the control 800 described with reference to FIGS. 20–29.

The operation of the illustrative embodiment will be described more specifically. After image data representative of a document image and generated by image reading section 4 of the copier body 1 have been reproduced on a sheet by the image recording section 40, the sheet, or copy, is transferred from the copier body 1 to the finisher 3. In the SSB mode (staple mode), the transporting means 910 of the finisher 3 conveys the sheet to and lays it on the predetermined surface of the finish tray 400. It is to be noted that since the copier body 1 produces recordings and discharges them in order of the cover page and first and successive pages, the finisher 3 staples a sheet stack S at part of the latter (right or left) as soon as the last page is reproduced.

Usually, a horizontal line and left staple mode is set up during the SSB mode operation. When the position change key 525 is pressed, the horizontal line and left staple mode is replaced with a vertical line and right staple mode (and restored when the key 525 is pressed again). Then, the order of data transfer from the video memory 1105 to the write control board 1106 is changed, or the data in the video memory 1105 are rearranged as shown in FIG. 45, whereby the image to be reproduced is rotated 180 degrees. Alternatively, the image reading section 4 may scan the document in the opposite direction, as stated earlier. Specifically, when the image data are written in vertical lines, an image to be recorded is rotated 180 degrees, as shown in FIGS. 44A and 44B. This allows the stapler 301 located at the right-hand side or the left-hand side to selectively staple a stack S at the right margin or the left margin of the latter.

FIGS. 44A and 44B are provided merely as illustrations of possible preferred stapling positions. It is to be understood that if the stapler is located on the right-hand side of the stack, a stack can be stapled at the right-hand margin, or if the image is rotated 180 degrees with the stapler located at the right-hand side of the stack, the stack can be stapled on the left margin of the stack. Similarly, if the stapler is located on the left-hand side of the stack, the stack can be readily stapled at the left margin, or with the image rotated 180 degrees, the left-hand side stapler provides a staple on the right margin. Thus, as stated earlier, the staple can be located at the right-hand side or the left-hand side, while allowing for stapling of the stack at the right margin or the left margin in either instance.

The advantages achievable with this embodiment are comparable with the advantages described in relation to the foregoing embodiments.

In summary, it will be seen that the present invention provides a binding device which desirably binds a sheet stack without causing individual sheets of the stack from folding or causing the bent legs of staples from appearing, allows a particular mode matching the application to be selected, and prevents the individual sheets from being dislocated. When image information is printed on a document in vertical lines, an image to be recorded in a sheet is rotated 180 degrees. This implements a small size and low cost binding device capable of selectively binding a sheet stack at the right margin or the left margin with binding means located at the right-hand side or the left-hand side.

Various modifications will become possible for those skilled in the art after receiving the teachings of the present disclosure without departing from the scope thereof. For example, while the finisher 3 has been shown and described as being connected to the right-hand side of the copier body 1, it may, of course, be connected to the left-hand side of the same.

What is claimed is:

1. A device for binding a stack of recording sheets each carrying an image formed by an image forming apparatus, comprising:

a binding device for stapling a stack of sheets in any one of a plurality of predetermined modes; and wherein said plurality of modes comprise a bind mode for binding only the stack of recording sheets, and a special bind mode for binding the stack of recording sheets together with a cover sheet which is at least twice as large in size as the recording sheets.

2. A device as claimed in claim 1, wherein said plurality of modes further comprise a cover bind mode for binding the stack of recording sheets together with at least one of a front cover sheet and a rear cover sheet each having the same size as the recording sheets.

3. A device as claimed in claim 1, wherein said plurality of modes further include a two staple bind mode which is automatically selected for binding the stack of recording sheets at two spaced positions in a binding margin.

4. A device as claimed in claim 1, further including means to rotate an image to be reproduced on the recording sheet by 180 degrees to change a binding position, depending on whether the image is written in vertical lines or in horizontal lines.

* * * * *